US011298577B2

(12) United States Patent
Watterson

(10) Patent No.: US 11,298,577 B2
(45) Date of Patent: Apr. 12, 2022

(54) CABLE AND POWER RACK EXERCISE MACHINE

(71) Applicant: ICON Health & Fitness, Inc., Logan, UT (US)

(72) Inventor: Scott R. Watterson, Logan, UT (US)

(73) Assignee: iFIT Inc., Logan, UT (US)

( * ) Notice: Subject to any disclaimer, the term of this patent is extended or adjusted under 35 U.S.C. 154(b) by 60 days.

(21) Appl. No.: 16/780,765

(22) Filed: Feb. 3, 2020

(65) Prior Publication Data

US 2020/0254295 A1 Aug. 13, 2020

Related U.S. Application Data

(60) Provisional application No. 62/804,146, filed on Feb. 11, 2019.

(51) Int. Cl.
*A63B 21/075* (2006.01)
*A63B 21/00* (2006.01)
(Continued)

(52) U.S. Cl.
CPC ..... *A63B 21/075* (2013.01); *A63B 21/005* (2013.01); *A63B 21/0058* (2013.01);
(Continued)

(58) Field of Classification Search
CPC ..... A63B 21/075; A63B 21/154; A63B 24/0075; A63B 24/0087; A63B 71/0622;
(Continued)

(56) References Cited

U.S. PATENT DOCUMENTS 3,123,646 A 3/1964 Easton
3,579,339 A 5/1971 Chang
(Continued)

FOREIGN PATENT DOCUMENTS

CN 2172137 7/1994
CN 2172137 Y 7/1994
(Continued)

OTHER PUBLICATIONS

*Tonal Systems, Inc.* v. *ICON Health & Fitness, Inc.*, Case No. DDE-1-20-cv-01197, Complaint for Declaratory Judgment filed Sep. 8, 2020, 6 pages.
(Continued)

*Primary Examiner* — Garrett K Atkinson
*Assistant Examiner* — Kathleen M Fisk
(74) *Attorney, Agent, or Firm* — Foley & Lardner LLP

(57) ABSTRACT

Cable and power rack exercise machine. An exercise machine may include a frame, a resistance mechanism supported by the frame, a first pull cable and a second pull cable supported by the frame and linked to the resistance mechanism, and a power rack attached to the frame. The power rack may include a first upright post configured to have a first barbell holder adjustably attached thereto and a second upright post configured to have a second barbell holder adjustably attached thereto. The first barbell holder may be adjusted in various positions between a first highest position and a first lowest position on the first upright post. The second barbell holder may also be adjusted in various positions between a second highest position and a second lowest position on the second upright post.

20 Claims, 11 Drawing Sheets

(51) Int. Cl.

| | |
|---|---|
| ***A63B 21/078*** | (2006.01) |
| ***A63B 21/072*** | (2006.01) |
| ***A63B 21/22*** | (2006.01) |
| ***A63B 21/02*** | (2006.01) |
| ***A63B 21/005*** | (2006.01) |
| ***A63B 24/00*** | (2006.01) |
| ***A63B 71/06*** | (2006.01) |
| *A63B 23/04* | (2006.01) |

(52) U.S. Cl.

CPC ..... *A63B 21/023* (2013.01); *A63B 21/072* (2013.01); *A63B 21/0724* (2013.01); *A63B 21/0783* (2015.10); *A63B 21/153* (2013.01); *A63B 21/154* (2013.01); *A63B 21/156* (2013.01); *A63B 21/225* (2013.01); *A63B 24/0075* (2013.01); *A63B 24/0087* (2013.01); *A63B 71/0622* (2013.01); *A63B 2023/0411* (2013.01); *A63B 2071/0625* (2013.01); *A63B 2208/0223* (2013.01); *A63B 2225/74* (2020.08)

(58) Field of Classification Search

CPC ..... A63B 21/156; A63B 21/0783; A63B 21/0724; A63B 2225/74; A63B 2071/0625; A63B 2208/0223; A63B 2208/0252; A63B 23/1236; A63B 2023/0411; A63B 23/0405; A63B 21/00192; A63B 21/225; A63B 21/00181; A63B 21/153; A63B 21/4035; A63B 2220/803; A63B 2208/0204; A63B 2209/10; A63B 2220/833; A63B 2220/806; A63B 2024/0068; A63B 71/0036; A63B 2024/0093; A63B 71/023; A63B 2230/75; A63B 2071/0694; A63B 2230/06; A63B 2071/065; A63B 2225/50; A63B 2225/20; A63B 2071/068; A63B 2230/40; A63B 2071/0072; A63B 2208/0233; A63B 2220/54; A63B 2220/80; A63B 2220/20; A63B 2225/685; A63B 2220/805; A63B 2244/09; A63B 21/00058; A63B 21/00069; A63B 21/00076; A63B 21/005–0059; A63B 21/02; A63B 21/022–026; A63B 21/072–08; A63B 21/15; A63B 21/151; A63B 21/22; A63B 21/227

USPC ..... 482/104

See application file for complete search history.

(56) References Cited

U.S. PATENT DOCUMENTS

| | | | | |
|---|---|---|---|---|
| 3,926,430 | A | 12/1975 | Good, Jr. | |
| 4,023,795 | A | 5/1977 | Pauls | |
| 4,300,760 | A | 11/1981 | Bobroff | |
| 4,533,136 | A | 8/1985 | Smith et al. | |
| D286,311 | S | 10/1986 | Martinell | |
| 4,681,318 | A | 7/1987 | Lay | |
| 4,684,126 | A | 8/1987 | Dalebout | |
| 4,725,057 | A | 2/1988 | Shifferaw | |
| 4,728,102 | A | 3/1988 | Pauls | |
| 4,750,736 | A | 6/1988 | Watterson | |
| 4,796,881 | A | 1/1989 | Watterson | |
| 4,813,667 | A | 3/1989 | Watterson | |
| 4,830,371 | A | 5/1989 | Lay | |
| 4,844,451 | A | 7/1989 | Bersonnet | |
| 4,850,585 | A | 7/1989 | Dalebout | |
| D304,849 | S | 11/1989 | Watterson | |
| 4,880,225 | A | 11/1989 | Lucas | |
| 4,883,272 | A | 11/1989 | Lay | |
| D306,468 | S | 3/1990 | Watterson | |
| D306,891 | S | 3/1990 | Watterson | |
| 4,913,396 | A | 4/1990 | Dalebout | |
| D307,614 | S | 5/1990 | Bingham | |
| D307,615 | S | 5/1990 | Bingham | |
| 4,921,242 | A | 5/1990 | Watterson | |
| 4,932,650 | A | 6/1990 | Bingham | |
| D309,167 | S | 7/1990 | Griffin | |
| D309,485 | S | 7/1990 | Bingham | |
| 4,938,478 | A | 7/1990 | Lay | |
| D310,253 | S | 8/1990 | Bersonnet | |
| 4,949,959 | A * | 8/1990 | Stevens | A63B 21/078 482/104 |
| 4,955,599 | A | 9/1990 | Bersonnet | |
| 4,968,028 | A | 11/1990 | Wehrell | |
| 4,971,316 | A | 11/1990 | Dalebout | |
| D313,055 | S | 12/1990 | Watterson | |
| 4,974,832 | A | 12/1990 | Dalebout | |
| 4,979,737 | A | 12/1990 | Kock | |
| 4,981,294 | A | 1/1991 | Dalebout | |
| 5,000,442 | A | 1/1991 | Dalebout et al. | |
| D315,765 | S | 3/1991 | Measom | |
| 4,998,721 | A * | 3/1991 | Anders | A63B 21/0783 482/4 |
| 4,998,725 | A | 3/1991 | Watterson | |
| 5,000,443 | A | 3/1991 | Dalebout | |
| 5,000,444 | A | 3/1991 | Dalebout | |
| D316,124 | S | 4/1991 | Dalebout | |
| 5,013,033 | A | 5/1991 | Watterson | |
| 5,014,980 | A | 5/1991 | Bersonnet | |
| 5,016,871 | A | 5/1991 | Dalebout | |
| D318,085 | S | 7/1991 | Jacobson | |
| D318,086 | S | 7/1991 | Bingham | |
| D318,699 | S | 7/1991 | Jacobson | |
| 5,029,801 | A | 7/1991 | Dalebout | |
| 5,034,576 | A | 7/1991 | Dalebout | |
| 5,039,091 | A | 8/1991 | Johnson | |
| 5,048,826 | A * | 9/1991 | Ryan | A63B 21/078 482/7 |
| 5,058,881 | A | 10/1991 | Measom | |
| 5,058,882 | A | 10/1991 | Dalebout | |
| D321,388 | S | 11/1991 | Dalebout | |
| 5,062,626 | A | 11/1991 | Dalebout | |
| 5,062,627 | A | 11/1991 | Bingham | |
| 5,062,632 | A | 11/1991 | Dalebout | |
| 5,062,633 | A | 11/1991 | Engel | |
| 5,067,710 | A | 11/1991 | Watterson | |
| 5,072,929 | A | 12/1991 | Peterson | |
| D323,009 | S | 1/1992 | Dalebout | |
| D323,198 | S | 1/1992 | Dalebout | |
| D323,199 | S | 1/1992 | Dalebout | |
| D323,863 | S | 2/1992 | Watterson | |
| 5,088,729 | A | 2/1992 | Dalebout | |
| 5,090,694 | A | 2/1992 | Pauls | |
| 5,102,380 | A | 4/1992 | Jacobson | |
| 5,104,120 | A | 4/1992 | Watterson | |
| 5,108,093 | A | 4/1992 | Watterson | |
| D326,491 | S | 5/1992 | Dalebout | |
| 5,122,105 | A | 6/1992 | Engel | |
| 5,135,216 | A | 8/1992 | Bingham | |
| 5,147,265 | A | 9/1992 | Pauls | |
| 5,149,084 | A | 9/1992 | Dalebout | |
| 5,149,312 | A | 9/1992 | Croft et al. | |
| 5,171,196 | A | 12/1992 | Lynch | |
| D332,347 | S | 1/1993 | Raadt | |
| 5,190,505 | A | 3/1993 | Dalebout | |
| 5,192,255 | A | 3/1993 | Dalebout | |
| 5,195,937 | A | 3/1993 | Engel | |
| 5,203,826 | A | 4/1993 | Dalebout | |
| D335,511 | S | 5/1993 | Engel | |
| D335,905 | S | 5/1993 | Cutter | |
| D336,498 | S | 6/1993 | Engel | |
| 5,217,487 | A | 6/1993 | Engel | |
| D337,361 | S | 7/1993 | Engel | |
| D337,666 | S | 7/1993 | Peterson | |
| D337,799 | S | 7/1993 | Cutter | |
| 5,226,866 | A | 7/1993 | Engel | |
| 5,244,446 | A | 9/1993 | Engel | |
| 5,247,853 | A | 9/1993 | Dalebout | |
| 5,259,611 | A | 11/1993 | Dalebout | |

(56) References Cited

U.S. PATENT DOCUMENTS

D342,106 S 12/1993 Campbell
5,279,528 A 1/1994 Dalebout
D344,112 S 2/1994 Smith
D344,557 S 2/1994 Ashby
5,282,776 A 2/1994 Dalebout
5,286,243 A 2/1994 Lapcevic
5,295,931 A 3/1994 Dreibelbis
5,302,161 A 4/1994 Loubert
D347,251 S 5/1994 Dreibelbis
5,316,534 A 5/1994 Dalebout
D348,493 S 7/1994 Ashby
D348,494 S 7/1994 Ashby
5,328,164 A 7/1994 Soga
D349,931 S 8/1994 Bostic
5,336,142 A 8/1994 Dalebout
5,344,376 A 9/1994 Bostic et al.
D351,202 S 10/1994 Bingham
D351,435 S 10/1994 Peterson
D351,633 S 10/1994 Bingham
5,354,252 A 10/1994 Habing
D352,534 S 11/1994 Dreibelbis
D352,536 S 11/1994 Byrd et al.
5,362,298 A 11/1994 Brown
D353,422 S 12/1994 Bostic
5,372,559 A 12/1994 Dalebout
5,374,228 A 12/1994 Buisman
5,382,221 A 1/1995 Hsu
5,387,168 A 2/1995 Bostic
5,393,690 A 2/1995 Fu
D356,128 S 3/1995 Smith
5,407,403 A * 4/1995 Coleman ..... A63B 21/00181 482/104
5,409,435 A * 4/1995 Daniels ..... A63B 21/0056 482/5
5,429,563 A 7/1995 Engel
5,431,612 A 7/1995 Holden
D360,915 S 8/1995 Bostic
5,468,205 A 11/1995 McFall
5,484,358 A 1/1996 Wang et al.
5,489,249 A 2/1996 Brewer
5,492,517 A 2/1996 Bostic
D367,689 S 3/1996 Wilkinson
5,511,740 A 4/1996 Loubert
5,512,025 A 4/1996 Dalebout
D370,949 S 6/1996 Furner
D371,176 S 6/1996 Furner
5,527,245 A 6/1996 Dalebout et al.
5,529,553 A 6/1996 Finlayson
5,540,429 A 7/1996 Dalebout
5,549,533 A 8/1996 Olson
5,554,085 A 9/1996 Dalebout
5,569,128 A 10/1996 Dalebout
5,588,938 A 12/1996 Schneider et al.
5,591,105 A 1/1997 Dalebout
5,591,106 A 1/1997 Dalebout
5,595,556 A 1/1997 Dalebout
5,607,375 A 3/1997 Dalebout
5,611,539 A 3/1997 Watterson
5,622,527 A 4/1997 Watterson
5,626,538 A 5/1997 Dalebout
5,626,542 A 5/1997 Dalebout
D380,024 S 6/1997 Novak
5,637,059 A 6/1997 Dalebout
D380,509 S 7/1997 Wilkinson
5,643,153 A 7/1997 Nylen
5,645,509 A 7/1997 Brewer
D384,118 S 9/1997 Deblauw
5,662,557 A 9/1997 Watterson
5,669,857 A 9/1997 Watterson
5,672,140 A 9/1997 Watterson
5,674,156 A 10/1997 Watterson
5,674,453 A 10/1997 Watterson
5,676,624 A 10/1997 Watterson
5,683,331 A 11/1997 Dalebout
5,683,332 A 11/1997 Watterson
D387,825 S 12/1997 Fleck
5,695,433 A 12/1997 Buisman
5,695,434 A 12/1997 Dalebout
5,695,435 A 12/1997 Dalebout
5,697,869 A * 12/1997 Ehrenfried ..... A63B 21/0058 482/129
5,702,325 A 12/1997 Watterson
5,704,879 A 1/1998 Watterson
5,718,657 A 2/1998 Dalebout et al.
5,720,200 A 2/1998 Anderson
5,720,698 A 2/1998 Dalebout
D392,006 S 3/1998 Dalebout
5,722,922 A 3/1998 Watterson
5,733,229 A 3/1998 Dalebout
5,743,833 A 4/1998 Watterson
5,762,584 A 6/1998 Daniels
5,762,587 A 6/1998 Dalebout
5,772,560 A 6/1998 Watterson
5,810,698 A 9/1998 Hullett
5,827,155 A 10/1998 Jensen
5,830,113 A 11/1998 Goody et al.
5,830,114 A 11/1998 Halfen
5,860,893 A 1/1999 Watterson
5,860,894 A 1/1999 Dalebout
5,899,834 A 5/1999 Dalebout
D412,953 S 8/1999 Armstrong
D413,948 S 9/1999 Dalebout
5,951,441 A 9/1999 Dalebout
5,951,448 A 9/1999 Bolland
D416,596 S 11/1999 Armstrong
5,989,164 A * 11/1999 Kullman ..... A63B 21/0783 482/104
6,003,166 A 12/1999 Hald
6,019,710 A 2/2000 Dalebout
6,027,429 A 2/2000 Daniels
6,030,320 A 2/2000 Stearns et al.
6,030,321 A 2/2000 Fuentes
6,033,347 A 3/2000 Dalebout et al.
D425,940 S 5/2000 Halfen
6,059,692 A 5/2000 Hickman
D428,949 S 8/2000 Simonson
6,123,646 A 9/2000 Colassi
6,123,649 A 9/2000 Lee et al.
6,171,217 B1 1/2001 Cutler
6,171,219 B1 1/2001 Simonson
6,174,267 B1 1/2001 Dalebout
6,193,631 B1 2/2001 Hickman
6,228,003 B1 5/2001 Hald
6,238,323 B1 5/2001 Simonson
6,251,052 B1 6/2001 Simonson
6,261,022 B1 7/2001 Dalebout et al.
6,280,362 B1 8/2001 Dalebout et al.
6,296,594 B1 10/2001 Simonson
D450,872 S 11/2001 Dalebout
6,312,363 B1 11/2001 Watterson
D452,338 S 12/2001 Dalebout
D453,543 S 2/2002 Cutler
D453,948 S 2/2002 Cutler
6,350,218 B1 2/2002 Dalebout et al.
D457,580 S 5/2002 Webber
6,387,020 B1 5/2002 Simonson
6,413,191 B1 7/2002 Harris
6,422,980 B1 7/2002 Simonson
6,436,008 B1 8/2002 Skowronski et al.
6,447,424 B1 9/2002 Ashby et al.
6,454,679 B1 9/2002 Radow
6,458,060 B1 10/2002 Watterson
6,458,061 B2 10/2002 Simonson
6,471,622 B1 10/2002 Hammer
6,488,612 B2 12/2002 Sechrest
6,491,610 B1 12/2002 Henn
6,563,225 B2 5/2003 Soga
6,599,223 B2 7/2003 Wang
6,601,016 B1 7/2003 Brown
6,623,140 B2 9/2003 Watterson
6,626,799 B2 9/2003 Watterson
6,652,424 B2 11/2003 Dalebout
6,669,607 B2 * 12/2003 Slawinski ..... A63B 21/00181 482/104

(56) References Cited

U.S. PATENT DOCUMENTS 6,685,607 B1 2/2004 Olson
6,695,581 B2 2/2004 Wasson
6,699,159 B2 3/2004 Rouse
6,701,271 B2 3/2004 Willner
6,702,719 B1 3/2004 Brown
6,712,740 B2 3/2004 Simonson
6,730,002 B2 5/2004 Hald
6,743,153 B2 6/2004 Watterson
6,746,371 B1 6/2004 Brown et al.
6,749,537 B1 6/2004 Hickman
6,761,667 B1 7/2004 Cutler et al.
6,770,015 B2 8/2004 Simonson
6,786,852 B2 9/2004 Watterson
6,808,472 B1 10/2004 Hickman
6,811,520 B2 11/2004 Wu
6,821,230 B2 11/2004 Dalebout
6,830,540 B2 12/2004 Watterson
6,837,830 B2 1/2005 Eldridge
6,857,993 B2 2/2005 Yeh
6,863,641 B1 3/2005 Brown
6,866,613 B1 3/2005 Brown
6,875,160 B2 4/2005 Watterson
D507,311 S 7/2005 Butler
6,918,858 B2 7/2005 Watterson
6,921,351 B1 7/2005 Hickman
6,958,032 B1 10/2005 Smith
D511,190 S 11/2005 Panatta
D512,113 S 11/2005 Carter
6,974,404 B1 12/2005 Watterson
6,997,852 B2 2/2006 Watterson
7,011,326 B1 3/2006 Schroeder et al.
7,025,713 B2 4/2006 Dalebout
D520,085 S 5/2006 Willardson et al.
7,044,897 B2 5/2006 Myers
7,052,442 B2 5/2006 Watterson
7,060,006 B1 6/2006 Watterson
7,060,008 B2 6/2006 Watterson et al.
7,070,539 B2 7/2006 Brown
7,070,546 B1 * 7/2006 Grasso ..... A63B 21/072 482/103
7,097,588 B2 8/2006 Watterson
D527,776 S 9/2006 Willardson
7,112,168 B2 9/2006 Dalebout et al.
7,128,693 B2 10/2006 Brown
7,163,488 B2 * 1/2007 Anders ..... A63B 21/0724 482/104
7,166,062 B1 1/2007 Watterson
7,166,064 B2 1/2007 Watterson
7,169,087 B2 1/2007 Ercanbrack
7,169,093 B2 1/2007 Simonson
7,192,388 B2 3/2007 Dalebout
7,226,402 B1 6/2007 Joya
7,250,022 B2 7/2007 Dalebout
D552,193 S 10/2007 Husted et al.
7,282,016 B2 10/2007 Simonson
7,285,075 B2 10/2007 Cutler
7,311,640 B2 12/2007 Baatz
7,344,481 B2 3/2008 Watterson
7,364,538 B2 4/2008 Aucamp
7,377,882 B2 5/2008 Watterson
7,381,161 B2 6/2008 Ellis
7,425,188 B2 9/2008 Ercanbrack
7,429,236 B2 9/2008 Dalebout
7,455,622 B2 11/2008 Watterson
7,482,050 B2 1/2009 Olson
D588,655 S 3/2009 Utykanski
7,510,509 B2 3/2009 Hickman
7,524,272 B2 4/2009 Burck et al.
7,537,546 B2 5/2009 Watterson
7,537,549 B2 5/2009 Nelson
7,537,552 B2 5/2009 Dalebout
7,540,828 B2 6/2009 Watterson et al.
7,549,947 B2 6/2009 Hickman
7,556,590 B2 7/2009 Watterson et al.
7,563,203 B2 7/2009 Dalebout
7,575,536 B1 8/2009 Hickman
7,575,537 B2 8/2009 Ellis
7,584,673 B2 9/2009 Shimizu
7,601,105 B1 10/2009 Gipson, III
7,604,572 B2 10/2009 Stanford
7,604,573 B2 10/2009 Dalebout
D604,373 S 11/2009 Dalebout
7,618,350 B2 11/2009 Dalebout
7,618,357 B2 11/2009 Dalebout
7,625,315 B2 12/2009 Hickman
7,625,321 B2 12/2009 Simonson
7,628,730 B1 12/2009 Watterson
7,628,737 B2 12/2009 Kowallis
7,637,847 B1 12/2009 Hickman
7,641,597 B2 1/2010 Schmidt
7,645,212 B2 1/2010 Ashby et al.
7,645,213 B2 1/2010 Watterson
7,658,698 B2 2/2010 Pacheco
7,674,205 B2 3/2010 Dalebout
7,713,171 B1 5/2010 Hickman
7,713,172 B2 5/2010 Watterson
7,713,180 B2 5/2010 Wickens
7,717,828 B2 5/2010 Simonson
7,736,279 B2 6/2010 Dalebout
7,740,563 B2 6/2010 Dalebout et al.
7,749,144 B2 7/2010 Hammer
7,766,797 B2 8/2010 Dalebout
7,771,329 B2 8/2010 Dalebout
7,775,940 B2 8/2010 Dalebout
7,789,800 B1 9/2010 Watterson
7,798,946 B2 9/2010 Dalebout
7,815,550 B2 10/2010 Watterson
7,857,731 B2 12/2010 Hickman
7,862,475 B2 1/2011 Watterson
7,862,478 B2 1/2011 Watterson
7,862,483 B2 1/2011 Hendrickson
D633,581 S 3/2011 Thulin
D635,207 S 3/2011 Dalebout
7,901,330 B2 3/2011 Dalebout
7,909,740 B2 3/2011 Dalebout
7,942,793 B2 5/2011 Mills et al.
7,980,996 B2 7/2011 Hickman
7,981,000 B2 7/2011 Watterson
7,985,164 B2 7/2011 Ashby
7,998,038 B2 * 8/2011 Keiser ..... A63B 21/00069 482/112
8,029,415 B2 10/2011 Ashby et al.
8,029,425 B2 10/2011 Bronston et al.
8,033,960 B1 10/2011 Dalebout
D650,451 S 12/2011 Olson
8,070,657 B2 12/2011 Loach
D652,877 S 1/2012 Dalebout
8,096,926 B1 1/2012 Batca
8,152,702 B2 4/2012 Pacheco
D659,775 S 5/2012 Olson
D659,777 S 5/2012 Watterson
D660,383 S 5/2012 Watterson
D664,613 S 7/2012 Dalebout
8,251,874 B2 8/2012 Ashby
8,298,123 B2 10/2012 Hickman
8,298,125 B2 10/2012 Colledge
D671,177 S 11/2012 Sip
D671,178 S 11/2012 Sip
D673,626 S 1/2013 Olson
8,398,529 B2 3/2013 Ellis et al.
8,500,607 B2 8/2013 Mttone et al.
8,517,899 B2 8/2013 Zhou
8,550,964 B2 10/2013 Ish, III et al.
8,690,735 B2 4/2014 Watterson
D707,763 S 6/2014 Cutler
8,740,753 B2 6/2014 Olson
8,758,201 B2 6/2014 Ashby
8,764,609 B1 7/2014 Elahmadie
8,771,153 B2 7/2014 Dalebout
8,784,270 B2 7/2014 Watterson
8,808,148 B2 8/2014 Watterson
8,808,152 B1 8/2014 Midgett
8,814,762 B2 8/2014 Butler
D712,493 S 9/2014 Ercanbrack

(56) References Cited

U.S. PATENT DOCUMENTS 8,840,075 B2 9/2014 Olson
8,845,493 B2 9/2014 Watterson
8,870,726 B2 10/2014 Watterson
8,876,668 B2 11/2014 Hendrickson
8,894,549 B2 11/2014 Colledge
8,894,555 B2 11/2014 Olson
8,911,330 B2 12/2014 Watterson
8,920,288 B2 12/2014 Dalebout
8,986,165 B2 3/2015 Ashby
8,992,364 B2 3/2015 Law
8,992,387 B2 3/2015 Watterson
D726,476 S 4/2015 Ercanbrack
9,011,291 B2 4/2015 Birrell
9,028,368 B2 5/2015 Ashby
9,028,370 B2 5/2015 Watterson
9,039,578 B2 5/2015 Dalebout
D731,011 S 6/2015 Buchanan
9,044,635 B2 6/2015 Lull
9,050,496 B2 * 6/2015 Towley, III ..... A63B 21/0428
9,072,930 B2 7/2015 Ashby
9,119,983 B2 9/2015 Rhea
9,123,317 B2 9/2015 Watterson
9,126,071 B2 9/2015 Smith
9,126,072 B2 9/2015 Watterson
9,138,615 B2 9/2015 Olson
9,142,139 B2 9/2015 Watterson
9,144,703 B2 9/2015 Dalebout
9,149,683 B2 9/2015 Smith
9,170,223 B2 10/2015 Hyun
9,186,535 B2 11/2015 Ercanbrack
9,186,549 B2 11/2015 Watterson
D746,388 S 12/2015 Hockridge
9,211,433 B2 12/2015 Hall
9,254,409 B2 2/2016 Dalebout et al.
9,254,416 B2 2/2016 Ashby
9,278,248 B2 3/2016 Tyger
9,278,249 B2 3/2016 Watterson
9,278,250 B2 3/2016 Buchanan
9,289,648 B2 3/2016 Watterson
9,327,160 B2 * 5/2016 Tauriainen ..... A63B 21/0783
9,339,691 B2 5/2016 Brammer
9,352,185 B2 5/2016 Hendrickson
9,352,186 B2 5/2016 Watterson
9,375,605 B2 6/2016 Tyger
9,381,394 B2 7/2016 Mortensen
9,387,387 B2 7/2016 Dalebout
9,393,453 B2 7/2016 Watterson
9,403,047 B2 8/2016 Olson et al.
9,403,051 B2 8/2016 Cutler
9,415,257 B2 8/2016 Habing
9,421,416 B2 8/2016 Mortensen
9,457,219 B2 10/2016 Smith
9,457,220 B2 10/2016 Olson
9,457,222 B2 10/2016 Dalebout
9,460,632 B2 10/2016 Watterson
9,463,356 B2 10/2016 Rhea
9,468,793 B2 10/2016 Salmon
9,468,794 B2 10/2016 Barton
9,468,798 B2 10/2016 Dalebout
9,480,874 B2 11/2016 Cutler
9,492,701 B1 * 11/2016 Bognatz ..... A63B 21/072
9,492,704 B2 11/2016 Mortensen
9,498,668 B2 11/2016 Smith
9,511,259 B2 12/2016 Mountain
9,517,378 B2 12/2016 Ashby
9,521,901 B2 12/2016 Dalebout
9,533,187 B2 1/2017 Dalebout
9,539,458 B1 1/2017 Ross
9,539,461 B2 1/2017 Ercanbrack
9,579,544 B2 2/2017 Watterson
9,586,086 B2 3/2017 Dalebout
9,586,090 B2 3/2017 Watterson
9,604,099 B2 3/2017 Taylor
9,616,276 B2 4/2017 Dalebout et al.
9,616,278 B2 4/2017 Olson
9,623,281 B2 4/2017 Hendrickson
9,636,567 B2 5/2017 Brammer
9,662,529 B2 5/2017 Miller et al.
9,675,839 B2 6/2017 Dalebout
9,682,307 B2 6/2017 Dalebout
9,694,234 B2 7/2017 Dalebout
9,694,242 B2 7/2017 Ashby
9,700,751 B2 7/2017 Verdi
9,707,435 B1 * 7/2017 Ferlito ..... A63B 21/063
9,737,755 B2 8/2017 Dalebout
9,757,605 B2 9/2017 Olson et al.
9,764,186 B2 9/2017 Dalebout
9,767,785 B2 9/2017 Ashby
9,795,822 B2 10/2017 Smith
9,808,672 B2 11/2017 Dalebout
9,849,326 B2 12/2017 Smith
D807,445 S 1/2018 Gettle
9,878,200 B2 1/2018 Edmondson
9,878,210 B2 1/2018 Watterson
9,889,334 B2 2/2018 Ashby
9,889,339 B2 2/2018 Douglass
9,937,376 B2 4/2018 McInelly
9,937,377 B2 4/2018 McInelly
9,937,378 B2 4/2018 Dalebout
9,937,379 B2 4/2018 Mortensen
9,943,719 B2 4/2018 Smith
9,943,722 B2 4/2018 Dalebout
9,948,037 B2 4/2018 Ashby
9,968,816 B2 5/2018 Olson et al.
9,968,821 B2 5/2018 Finlayson
9,968,823 B2 5/2018 Cutler
10,010,755 B2 7/2018 Watterson
10,010,756 B2 7/2018 Watterson
10,029,145 B2 7/2018 Douglass
D826,350 S 8/2018 Hochstrasser
10,046,196 B2 8/2018 Ercanbrack
D827,733 S 9/2018 Hochstrasser
10,065,064 B2 9/2018 Smith
10,071,285 B2 9/2018 Smith
10,085,586 B2 10/2018 Smith
10,086,254 B2 10/2018 Watterson
10,136,842 B2 11/2018 Ashby
10,143,880 B1 * 12/2018 Boatwright ..... A63B 21/078
10,186,161 B2 1/2019 Watterson
10,188,890 B2 1/2019 Olson et al.
10,207,143 B2 2/2019 Dalebout
10,207,145 B2 2/2019 Tyger
10,207,147 B2 2/2019 Ercanbrack
10,207,148 B2 2/2019 Powell
10,212,994 B2 2/2019 Watterson
10,220,259 B2 3/2019 Brammer
10,226,396 B2 3/2019 Ashby
10,226,661 B2 * 3/2019 Henniger ..... A63B 23/1218
10,226,664 B2 3/2019 Dalebout
10,252,109 B2 4/2019 Watterson
10,258,828 B2 4/2019 Dalebout
10,272,317 B2 4/2019 Watterson
10,279,212 B2 5/2019 Dalebout et al.
10,293,211 B2 5/2019 Watterson et al.
D852,292 S 6/2019 Cutler
10,343,017 B2 7/2019 Jackson
10,376,736 B2 8/2019 Powell
10,388,183 B2 8/2019 Watterson
10,391,361 B2 8/2019 Watterson
D864,320 S 10/2019 Weston
D864,321 S 10/2019 Weston
10,426,989 B2 10/2019 Dalebout
10,433,612 B2 10/2019 Ashby
10,441,840 B2 10/2019 Dalebout et al.
10,449,416 B2 10/2019 Dalebout
D868,090 S 12/2019 Cutler et al.
D868,909 S 12/2019 Cutler
10,492,519 B2 12/2019 Capell
10,493,349 B2 12/2019 Watterson
10,500,473 B2 12/2019 Watterson
10,543,395 B2 1/2020 Powell et al.
10,561,877 B2 2/2020 Workman
10,561,893 B2 2/2020 Chatterton
10,561,894 B2 2/2020 Dalebout

(56) References Cited

U.S. PATENT DOCUMENTS 10,569,121 B2 2/2020 Watterson
10,569,123 B2 2/2020 Hochstrasser
10,668,320 B2 6/2020 Watterson
10,709,925 B2 7/2020 Dalebout et al.
10,758,767 B2 9/2020 Olson et al.
10,953,268 B1 3/2021 Dalebout et al.
10,967,214 B1 4/2021 Olson et al.
10,994,173 B2 5/2021 Watterson
11,058,913 B2 7/2021 Dalebout et al.
2001/0016542 A1 8/2001 Yoshimura
2002/0002104 A1 1/2002 Panatta
2002/0013200 A1 1/2002 Sechrest
2002/0016235 A1 2/2002 Ashby
2002/0025888 A1 2/2002 Germanton
2002/0077221 A1 6/2002 Dalebout
2002/0086779 A1 7/2002 Wilkinson
2002/0159253 A1 10/2002 Dalebout
2003/0032528 A1 2/2003 Wu et al.
2003/0032531 A1 2/2003 Simonson
2003/0032535 A1 2/2003 Wang et al.
2003/0045406 A1 3/2003 Stone
2003/0171192 A1 9/2003 Wu et al.
2003/0176261 A1 9/2003 Simonson et al.
2003/0181293 A1 9/2003 Baatz
2004/0043873 A1 3/2004 Wilkinson et al.
2004/0091307 A1 5/2004 James
2004/0102292 A1 5/2004 Pyles et al.
2004/0171464 A1 9/2004 Ashby
2004/0171465 A1 9/2004 Hald
2004/0176224 A1* 9/2004 Slawinski ..... A63B 21/078 482/93
2004/0176227 A1 9/2004 Endelman
2004/0204294 A2 10/2004 Wilkinson
2005/0049117 A1 3/2005 Rodgers
2005/0049123 A1 3/2005 Dalebout
2005/0077805 A1 4/2005 Dalebout
2005/0107229 A1 5/2005 Wickens
2005/0130814 A1 6/2005 Nitta et al.
2005/0148445 A1 7/2005 Carle
2005/0164837 A1 7/2005 Anderson et al.
2005/0164839 A1 7/2005 Watterson
2005/0272577 A1 12/2005 Olson
2006/0035755 A1 2/2006 Dalebout et al.
2006/0035768 A1 2/2006 Kowalllis et al.
2006/0148622 A1 7/2006 Chen
2006/0240955 A1 10/2006 Pu
2006/0252613 A1 11/2006 Barnes et al.
2007/0037674 A1 2/2007 Finn et al.
2007/0049472 A1* 3/2007 Hummer ..... A63B 71/0036 482/104
2007/0117683 A1 5/2007 Ercanbrack
2007/0123395 A1 5/2007 Ellis
2007/0173392 A1 7/2007 Stanford
2007/0179030 A1* 8/2007 Slawinski ..... A63B 21/075 482/98
2007/0197346 A1 8/2007 Seliber
2007/0232463 A1 10/2007 Wu
2007/0254778 A1 11/2007 Ashby
2007/0287601 A1 12/2007 Burck et al.
2008/0051256 A1 2/2008 Ashby et al.
2008/0119337 A1 5/2008 Wilkins et al.
2008/0242511 A1 10/2008 Munoz
2008/0242520 A1 10/2008 Hubbard
2008/0300110 A1 12/2008 Smith
2009/0036276 A1 2/2009 Loach
2009/0105052 A1 4/2009 Dalebout
2009/0312162 A1* 12/2009 Maiaro ..... A63B 21/0783 482/104
2010/0197462 A1 8/2010 Piane, Jr.
2010/0242246 A1 9/2010 Dalebout
2010/0255965 A1 10/2010 Chen
2011/0009249 A1 1/2011 Campanaro et al.
2011/0082013 A1 4/2011 Bastian
2011/0098155 A1* 4/2011 Lemos ..... A63B 21/06 482/5
2011/0281691 A1 11/2011 Ellis
2012/0058859 A1* 3/2012 Elsom-Cook .... A63B 21/00181 482/4
2012/0065034 A1 3/2012 Loach
2012/0088638 A1 4/2012 Lull
2012/0237911 A1 9/2012 Watterson
2012/0277068 A1 11/2012 Zhou et al.
2012/0295774 A1 11/2012 Dalebout
2013/0065732 A1 3/2013 Hopp
2013/0090216 A1 4/2013 Jackson
2013/0109543 A1 5/2013 Reyes
2013/0123073 A1 5/2013 Olson et al.
2013/0123083 A1 5/2013 Sip
2013/0165195 A1 6/2013 Watterson
2013/0172152 A1 7/2013 Watterson
2013/0172153 A1 7/2013 Watterson
2013/0178334 A1 7/2013 Brammer
2013/0178768 A1 7/2013 Dalebout
2013/0190136 A1 7/2013 Watterson
2013/0196298 A1 8/2013 Watterson
2013/0196821 A1 8/2013 Watterson et al.
2013/0196822 A1 8/2013 Watterson
2013/0218585 A1 8/2013 Watterson
2013/0244836 A1 9/2013 Maughan
2013/0267383 A1 10/2013 Watterson
2013/0268101 A1 10/2013 Brammer
2013/0274067 A1 10/2013 Watterson
2013/0281241 A1 10/2013 Watterson
2013/0303334 A1 11/2013 Adhami et al.
2013/0337981 A1 12/2013 Habing
2014/0024499 A1 1/2014 Watterson
2014/0038777 A1 2/2014 Bird
2014/0073970 A1 3/2014 Ashby
2014/0121071 A1 5/2014 Strom
2014/0135173 A1 5/2014 Watterson
2014/0187389 A1 7/2014 Berg
2014/0235409 A1 8/2014 Salmon et al.
2014/0274574 A1 9/2014 Shorten
2014/0274579 A1 9/2014 Olson
2014/0287884 A1 9/2014 Buchanan
2014/0309085 A1 10/2014 Watterson
2014/0357457 A1 12/2014 Boekema
2014/0371035 A1 12/2014 Mortensen et al.
2015/0038300 A1 2/2015 Forhan et al.
2015/0182779 A1 7/2015 Dalebout
2015/0182781 A1 7/2015 Watterson
2015/0238817 A1 8/2015 Watterson
2015/0250418 A1 9/2015 Ashby
2015/0251055 A1 9/2015 Ashby
2015/0253735 A1 9/2015 Watterson
2015/0253736 A1 9/2015 Watterson
2015/0258560 A1 9/2015 Ashby
2015/0306440 A1 10/2015 Bucher et al.
2015/0352396 A1 12/2015 Dalebout
2016/0058335 A1 3/2016 Ashby
2016/0063615 A1 3/2016 Watterson
2016/0092909 A1 3/2016 Watterson
2016/0101311 A1 4/2016 Workman
2016/0107065 A1 4/2016 Brammer
2016/0121074 A1 5/2016 Ashby
2016/0148535 A1 5/2016 Ashby
2016/0148536 A1 5/2016 Ashby
2016/0158595 A1 6/2016 Dalebout
2016/0303453 A1 10/2016 Kim
2016/0346595 A1 12/2016 Dalebout
2017/0036053 A1 2/2017 Smith
2017/0056711 A1 3/2017 Dalebout
2017/0056715 A1 3/2017 Dalebout
2017/0124912 A1 5/2017 Ashby
2017/0193578 A1 7/2017 Watterson
2017/0266481 A1 9/2017 Dalebout
2017/0266489 A1 9/2017 Douglass
2017/0266533 A1 9/2017 Dalebout
2017/0270820 A1 9/2017 Ashby
2017/0319941 A1 11/2017 Smith et al.
2018/0001135 A1 1/2018 Powell
2018/0036585 A1 2/2018 Powell

(56) References Cited

U.S. PATENT DOCUMENTS

| | | | | |
|---|---|---|---|---|
| 2018/0085630 | A1 | 3/2018 | Capell | |
| 2018/0089396 | A1 | 3/2018 | Capell | |
| 2018/0099116 | A1 | 4/2018 | Ashby | |
| 2018/0099180 | A1 | 4/2018 | Wilkinson | |
| 2018/0111034 | A1 | 4/2018 | Watterson | |
| 2018/0117385 | A1 | 5/2018 | Watterson | |
| 2018/0117393 | A1 | 5/2018 | Ercanbrack | |
| 2018/0154205 | A1 | 6/2018 | Watterson | |
| 2018/0154209 | A1 | 6/2018 | Watterson | |
| 2018/0200566 | A1 | 7/2018 | Weston | |
| 2018/0353795 | A1* | 12/2018 | Ostmeyer | A63B 23/035 |
| 2019/0058370 | A1 | 2/2019 | Tinney | |
| 2019/0080624 | A1 | 3/2019 | Watterson | |
| 2019/0151698 | A1 | 5/2019 | Olson et al. | |
| 2019/0168072 | A1 | 6/2019 | Brammer | |
| 2019/0178313 | A1 | 6/2019 | Wrobel | |
| 2019/0192898 | A1 | 6/2019 | Dalebout et al. | |
| 2019/0192952 | A1 | 6/2019 | Powell | |
| 2019/0209893 | A1 | 7/2019 | Watterson | |
| 2019/0223612 | A1 | 7/2019 | Watterson | |
| 2019/0232112 | A1 | 8/2019 | Watterson | |
| 2019/0269958 | A1 | 9/2019 | Dalebout et al. | |
| 2019/0269971 | A1 | 9/2019 | Capell | |
| 2019/0275366 | A1 | 9/2019 | Powell | |
| 2019/0282852 | A1 | 9/2019 | Dalebout | |
| 2019/0328079 | A1 | 10/2019 | Ashby | |
| 2019/0329091 | A1 | 10/2019 | Powell | |
| 2019/0376585 | A1 | 12/2019 | Buchanan | |
| 2020/0009417 | A1 | 1/2020 | Dalebout | |
| 2020/0016459 | A1 | 1/2020 | Smith | |
| 2020/0254295 | A1 | 8/2020 | Watterson | |
| 2020/0254309 | A1 | 8/2020 | Watterson | |
| 2020/0338389 | A1 | 10/2020 | Dalebout et al. | |
| 2020/0391069 | A1 | 12/2020 | Olson et al. | |

FOREIGN PATENT DOCUMENTS

| | | | |
|---|---|---|---|
| CN | 2291169 | Y | 6/1998 |
| CN | 101784308 | | 11/2001 |
| CN | 1658929 | | 8/2005 |
| CN | 1708333 | | 12/2005 |
| CN | 17808333 | | 12/2005 |
| CN | 2841072 | Y | 11/2006 |
| CN | 201516258 | | 6/2010 |
| CN | 101784308 | | 11/2011 |
| CN | 201410258 | Y | 2/2014 |
| CN | 103801048 | | 5/2014 |
| CN | 10488413 | | 9/2015 |
| CN | 103801048 | | 8/2016 |
| CN | 105848733 | | 8/2016 |
| CN | 104884133 | B | 2/2018 |
| CN | 106470739 | B | 6/2019 |
| CN | 110035801 | | 7/2019 |
| EP | 1188460 | | 3/2002 |
| EP | 2969058 | | 1/2016 |
| EP | 3086865 | A1 | 11/2016 |
| EP | 3086865 | A1 | 1/2020 |
| EP | 3086865 | | 2/2020 |
| EP | 3623020 | | 3/2020 |
| EP | 2969058 | | 5/2020 |
| JP | 2002-011114 | | 1/2002 |
| JP | 2013543749 | | 12/2013 |
| JP | 20133543749 | | 12/2013 |
| KR | 100 766 822 | B1 | 10/2007 |
| KR | 20100133609 | A | 12/2010 |
| SU | 1533710 | | 1/1990 |
| TW | M464203 | | 11/2013 |
| TW | M495871 | | 2/2015 |
| TW | 201821129 | A | 6/2018 |
| TW | 201821130 | A | 6/2018 |
| TW | 201601802 | A | 12/2018 |
| WO | 1989002217 | | 3/1989 |
| WO | 1997006859 | | 2/1997 |
| WO | 2002053234 | | 7/2002 |
| WO | 2002053234 | A1 | 7/2002 |
| WO | 2007015096 | A3 | 2/2007 |
| WO | 2009/000059 | | 12/2008 |
| WO | 2009/014330 | | 1/2009 |
| WO | 2013/0124509 | A1 | 8/2013 |
| WO | 2014153158 | | 9/2014 |
| WO | 2015/100429 | | 7/2015 |
| WO | 2015191445 | | 12/2015 |
| WO | 2018106598 | | 6/2018 |
| WO | 2018106603 | | 6/2018 |

OTHER PUBLICATIONS

*Tonal Systems, Inc.* v. *ICON Health & Fitness, Inc.*, Case No. DDE-1-20-cv-01197, Defendant's Answer and Counterclaims filed Sep. 30, 2020, 15 pages.

U.S. Appl. No. 61/920,834, filed Dec. 26, 2013, titled "Magnetic Resistance Mechanism in a Cable Machine", 31 pages.

Exxentric, Movie Archives, obtained from the Wayback Machine for http://exxentric.com/movies/ accessed for Aug. 19, 2015.

International Search Report & Written Opinion for PCT Application No. PCT/US2014/072390, dated Mar. 27, 2015, 9 pages.

Supplemental European Search Report for European Application No. 14/874,303, dated May 10, 2017, 6 pages.

*Nautilus, Inc.* v. *ICON Health & Fitness, Inc.*, Civil Case No. IPR2017-01363, Petition for Inter Partes Review of U.S. Pat. No. 9,403,047, filed May 5, 2017; 76 pages (paper 2).

*Nautilus, Inc.* v. *ICON Health & Fitness, Inc.*, Civil Case No. IPR2017-01363, Olson, U.S. Pat. No. 9,403,047, 16 pages, (Petition EX. 1001).

*Nautilus, Inc.* v. *ICON Health & Fitness, Inc.*, Civil Case No. IPR2017-01363, Sleamaker, U.S. Pat. No. 5,354,251, 14 pages, (Petition EX. 1002).

*Nautilus, Inc.* v. *ICON Health & Fitness, Inc.*, Civil Case No. IPR2017-01363, Hanoun, U.S. Publication No. 2007-0232452, 28 pages, (Petition EX. 1003).

*Nautilus, Inc.* v. *ICON Health & Fitness, Inc.*, Civil Case No. IPR2017-01363, Six-Pak, Printed Publication TuffStuff Fitness Six-Pak Trainer Owner's Manual, 19 pages, (Petition EX 1004).

*Nautilus, Inc.* v. *ICON Health & Fitness, Inc.*, Civil Case No. IPR2017-01363, Ehrenfried, U.S. Pat. No. 5,738,611, 19 pages, (Petition EX. 1005).

*Nautilus, Inc.* v. *ICON Health & Fitness, Inc.*, Civil Case No. IPR2017-01363, Kleinman, International Publication No. WO2008/152627, 65 pages, (Petition EX. 1006).

*Nautilus, Inc.* v. *ICON Health & Fitness, Inc.*, Civil Case No. IPR2017-01363, Declaration of Lee Rawls, (Petition EX. 1007).

*Nautilus, Inc.* v. *ICON Health & Fitness, Inc.*, Civil Case No. IPR2017-01363, U.S. Pat. No. 9,403,047 File history, 130 pages, (Petition EX. 1008).

*Nautilus, Inc.* v. *ICON Health & Fitness, Inc.*, Civil Case No. IPR2017-01363, U.S. Appl. No. 61/920,834, 38 pages, (Petition EX. 1009).

*Nautilus, Inc.* v. *ICON Health & Fitness, Inc.*, Civil Case No. IPR2017-01363, Declaration of Christopher Butler, 26 pages, (Petition EX. 1010).

*Nautilus, Inc.* v. *ICON Health & Fitness, Inc.*, Civil Case No. IPR2017-01363, Petitioner's Power of Attorney, filed May 5, 2017, 2 pages (paper 2).

*Nautilus, Inc.* v. *ICON Health & Fitness, Inc.*, Civil Case No. IPR2017-01363, Mandatory Notice to Patent Owner, filed May 19, 2017, 4 pages (paper 3).

*Nautilus, Inc.* v. *ICON Health & Fitness, Inc.*, Civil Case No. IPR2017-01363, Power of Attorney, filed May 19, 2017, 3 pages (paper 4).

*Nautilus, Inc.* v. *ICON Health & Fitness, Inc.*, Civil Case No. IPR2017-01363, Notice of Accord Filing Date, filed Jun. 9, 2017, 5 pages (paper 5).

U.S. Appl. No. 61/786,007, filed Mar. 14, 2013, titled "Strength Training Apparatus with Flywheel and Related Methods", 28 pages.

U.S. Appl. No. 62/009,607, filed Jun. 9, 2014, titled "Cable System Incorporated into a Treadmill", 32 pages.

International Search Report & Written Opinion for PCT Application No. PCT/US2014/029353, dated Aug. 4, 2014, 9 pages.

(56) References Cited

OTHER PUBLICATIONS

Supplemental European Search Report for European Application No. 14/768,130, dated Oct. 11, 2016, 9 pages.
U.S. Appl. No. 15/472,954, filed Mar. 29, 2017, titled "Strength Training Apparatus with Flywheel and Related Methods", 22 pages.
U.S. Appl. No. 15/976,496, filed May 10, 2018, titled "Magnetic Resistance Mechanism in a Cable Machine", 36 pages.
*Nautilus, Inc.* v. *ICON Health & Fitness, Inc.*, Civil Case No. IPR2017-01407, Petition for Inter Partes Review of U.S. Pat. No. 9,616,276 (Claims 1-4, 7-10), filed May 5, 2017.
*Nautilus, Inc.* v. *ICON Health & Fitness, Inc.*,Civil Case No. IPR2017-01407, Dalebout et al., U.S. Pat. No. 9,616,276, (Petition EX. 1001).
*Nautilus, Inc.* v. *ICON Health & Fitness, Inc.*, Civil Case No. IPR2017-01407, Wu, U.S. Publication No. 20030171192, (Petition EX. 1002).
*Nautilus, Inc.* v. *ICON Health & Fitness, Inc.*, Civil Case No. IPR2017-01407, Webb, U.S. Publication No. 20030017918, (Petition EX. 1003).
*Nautilus, Inc.* v. *ICON Health & Fitness, Inc.*, Civil Case No. IPR2017-01407, Watson, U.S. Publication No. 20060234840, (Petition EX. 1004).
*Nautilus, Inc.* v. *ICON Health & Fitness, Inc.*, Civil Case No. IPR2017-01407, Jones, U.S. Pat. No. 4,798,378, (Petition EX. 1005).
*Nautilus, Inc.* v. *ICON Health & Fitness, Inc.*, Civil Case No. IPR2017-01407, Zhou et al., U.S. Pat. No. 8,517,899, (Petition EX. 1006).
*Nautilus, Inc.* v. *ICON Health & Fitness, Inc.*, Civil Case No. IPR2017-01407, Loach, U.S. Publication No. WO2007015096, (Petition EX. 1007).
*Nautilus, Inc.* v. *ICON Health & Fitness, Inc.*, Civil Case No. IPR2017-01407, Rawls Declaration, Part 1 & 2, (Petition EX. 1008).
*Nautilus, Inc.* v. *ICON Health & Fitness, Inc.*, Civil Case No. IPR2017-01407, U.S. Pat. No. 9,616,276 File History, (Petition EX. 1009).
*Nautilus, Inc.* v. *ICON Health & Fitness, Inc.*, Civil Case No. IPR2017-01407, U.S. Appl. No. 61/786,007 File History, (Petition EX. 1010).
*Nautilus, Inc.* v. *ICON Health & Fitness, Inc.*, Civil Case No. IPR2017-01407, Sawicky, U.S. Pat. No. 5,042,798, (Petition EX. 1011).
*Nautilus, Inc.* v. *ICON Health & Fitness, Inc.*, Civil Case No. IPR2017-01407, Petitioner's Power of Attorney, filed May 5, 2017.
*Nautilus, Inc.* v. *ICON Health & Fitness, Inc.*, Civil Case No. IPR2017-01407, Mandatory Notice to Patent Owner, filed May 19, 2017.
*Nautilus, Inc.* v. *ICON Health & Fitness, Inc.*, Civil Case No. IPR2017-01407, Power of Attorney, filed May 19, 2017.
*Nautilus, Inc.* v. *ICON Health & Fitness, Inc.*, Civil Case No. IPR2017-01407, Notice of Accord Filing Date, filed Jun. 6, 2017.
*Nautilus, Inc.* v. *ICON Health & Fitness, Inc.*, Civil Case No. IPR2017-01408, Petition for Inter Partes Review of U.S. Pat. No. 9,616,276 (Claims 1-20) filed May 5, 2017.
*Nautilus, Inc.* v. *ICON Health & Fitness, Inc.*, Civil Case No. IPR2017-01408, Dalebout et al., U.S. Pat. No. 9,616,276, (Petition EX. 1001).
*Nautilus, Inc.* v. *ICON Health & Fitness, Inc.*, Civil Case No. IPR2017-01408, Wu, U.S. Publication No. 20030171192, (Petition EX. 1002).
*Nautilus, Inc.* v. *ICON Health & Fitness, Inc.*, Civil Case No. IPR2017-01408, Webb, U.S. Publication No. 20030017918, (Petition EX. 1003).
*Nautilus, Inc.* v. *ICON Health & Fitness, Inc.*, Civil Case No. IPR2017-01408, Watson, U.S. Publication No. 20060234840, (Petition EX. 1004).
*Nautilus, Inc.* v. *ICON Health & Fitness, Inc.*, Civil Case No. IPR2017-01408, Jones, U.S. Pat. No. 4,798,378, (Petition EX. 1005).
*Nautilus, Inc.* v. *ICON Health & Fitness, Inc.*, Civil Case No. IPR2017-01408, Zhou et al., U.S. Pat. No. 8,517,899, (Petition EX. 1006).
*Nautilus, Inc.* v. *ICON Health & Fitness, Inc.*, Civil Case No. IPR2017-01408, Loach, U.S. Publication No. WO2007015096, (Petition EX. 1007).
*Nautilus, Inc.* v. *ICON Health & Fitness, Inc.*, Civil Case No. IPR2017-01408, Rawls Declaration, Part 1 & 2, (Petition EX. 1008).
*Nautilus, Inc.* v. *ICON Health & Fitness, Inc.*, Civil Case No. IPR2017-01408, U.S. Pat. No. 9,616,276 File History, (Petition EX. 1009).
*Nautilus, Inc.* v. *ICON Health & Fitness, Inc.*, Civil Case No. IPR2017-01408, U.S. Appl. No. 61/786,007 File History, (Petition EX. 1010).
*Nautilus, Inc.* v. *ICON Health & Fitness, Inc.*, Civil Case No. IPR2017-01408, Sawicky, U.S. Pat. No. 5,042,798, (Petition EX. 1011).
*Nautilus, Inc.* v. *ICON Health & Fitness, Inc.*, Civil Case No. IPR2017-01408, Petitioner's Power of Attorney, filed May 5, 2017.
*Nautilus, Inc.* v. *ICON Health & Fitness, Inc.*, Civil Case No. IPR2017-01408, Mandatory Notice to Patent Owner, filed May 19, 2017.
*Nautilus, Inc.* v. *ICON Health & Fitness, Inc.*, Civil Case No. IPR2017-01408, Power of Attorney, filed May 19, 2017.
*Nautilus, Inc.* v. *ICON Health & Fitness, Inc.*, Civil Case No. IPR2017-01408, Notice of Accord Filing Date, filed Jun. 6, 2017.
Chinese Office Action for Chinese Patent Application No. 201480003701.9 dated Apr. 6, 2016.
Chinese Search Report for Chinese Patent Application No. 2014800708329 dated Jun. 2, 2017.
*Nautilus, Inc.* v. *ICON Health & Fitness, Inc.*, Civil Case No. IPR2017-01363, Declaration of Tyson Hottinger in Support of Motion for Admission PRO HAC VICE, filed Feb. 1, 2018 (Ex 2001).
*Nautilus, Inc.* v. *ICON Health & Fitness, Inc.*, Civil Case No. IPR2017-01363, Transcript of Deposition of R. Lee Rawls, filed Mar. 5, 2018 (Ex 2002).
*Nautilus, Inc.* v. *ICON Health & Fitness, Inc.*, Civil Case No. IPR2017-01363, Order Conduct of Proceedings, filed May 7, 2018 (Paper 20).
*Nautilus, Inc.* v. *ICON Health & Fitness, Inc.*, Civil Case No. IPR2017-01407, Decision Institution of Inter Partes Review, filed Dec. 4, 2017 (Paper 6).
*Nautilus, Inc.* v. *ICON Health & Fitness, Inc.*, Civil Case No. IPR2017-01407, Scheduling Order, filed Dec. 4, 2017 (Paper 7).
*Nautilus, Inc.* v. *ICON Health & Fitness, Inc.*, Civil Case No. IPR2017-01407, Order, filed Jan. 19, 2018 (Paper 8).
*Nautilus, Inc.* v. *ICON Health & Fitness, Inc.*, Civil Case No. IPR2017-01407, Patent Owner's Notice of Deposition of R. Lee Rawls, filed Jan. 19, 2018 (Paper 9).
*Nautilus, Inc.* v. *ICON Health & Fitness, Inc.*, Civil Case No. IPR2017-01407, Unopposed Motion for Pro Hac Vice Admission of Tyson Hottinger, filed Feb. 1, 2018 (Paper 10).
*Nautilus, Inc.* v. *ICON Health & Fitness, Inc.*, Civil Case No. IPR2017-01407, Patent Owner's Current Exhibit List, filed Feb. 1, 2018 (Paper 11).
*Nautilus, Inc.* v. *ICON Health & Fitness, Inc.*, Civil Case No. IPR2017-01407, Patent Owner's Updated Notice of Deposition of R. Lee Rawls, filed Feb. 1, 2018 (Paper 12).
*Nautilus, Inc.* v. *ICON Health & Fitness, Inc.*, Civil Case No. IPR2017-01407, Order Granting Motion of Pro Hac Vice Admission of Mr. Hottinger, filed Feb. 12, 2018 (Paper 13).
*Nautilus, Inc.* v. *ICON Health & Fitness, Inc.*, Civil Case No. IPR2017-01407, Petitioner's Updated Mandatory Notices, filed Feb. 20, 2018 (Paper 14).
*Nautilus, Inc.* v. *ICON Health & Fitness, Inc.*, Civil Case No. IPR2017-01407, Petitioner's Updated Power of Attorney, filed Feb. 20, 2018 (Paper 15).
*Nautilus, Inc.* v. *ICON Health & Fitness, Inc.*, Civil Case No. IPR2017-01407, Patent Owner's Motion to Amend, filed Mar. 5, 2018 (Paper 16).

(56) References Cited

OTHER PUBLICATIONS

*Nautilus, Inc.* v. *ICON Health & Fitness, Inc.*, Civil Case No. IPR2017-01407, Current Exhibit List of Patent Owner, filed Mar. 5, 2018 (Paper 17).
*Nautilus, Inc.* v. *ICON Health & Fitness, Inc.*, Civil Case No. IPR2017-01407, ORDER Conduct of Proceedings 37 C.F.R. Sec 42.5, filed Apr. 27, 2018 (Paper 18).
*Nautilus, Inc.* v. *ICON Health & Fitness, Inc.*, Civil Case No. IPR2017-01407, ORDER Conduct of Proceedings 37 C.F.R. Sec 42.5, filed May 7, 2018 (Paper 19).
*Nautilus, Inc.* v. *ICON Health & Fitness, Inc.*, Civil Case No. IPR2017-01407, Declaration of Tyson Hottinger in Support of Motion for Admission PRO HAC VICE, (Patent Owner EX. 2001).
*Nautilus, Inc.* v. *ICON Health & Fitness, Inc.*, Civil Case No. IPR2017-01407, Claim Listing of Proposed Substitute Claims for Patent Owner Motion to Amend, (Patent Owner EX. 2002).
*Nautilus, Inc.* v. *ICON Health & Fitness, Inc.*, Civil Case No. IPR2017-01407, Specification of Patent No. 9,616,276, (Patent Owner EX. 2003).
*Nautilus, Inc.* v. *ICON Health & Fitness, Inc.*, Civil Case No. IPR2017-01407, Drawings of Patent No. 9,616,276, (Patent Owner EX. 2004).
*Nautilus, Inc.* v. *ICON Health & Fitness, Inc.*, Civil Case No. IPR2017-01407, Specification of Patent No. 9,254,409 (Patent Owner EX. 2005).
*Nautilus, Inc.* v. *ICON Health & Fitness, Inc.*, Civil Case No. IPR2017-01407, Drawings of Patent No. 9,254,409 (Patent Owner EX. 2006).
*Nautilus, Inc.* v. *ICON Health & Fitness, Inc.*, Civil Case No. IPR2017-01407, Provisional Patent Specification of U.S. Appl. No. 61/786,007, (Patent Owner EX. 2007).
*Nautilus, Inc.* v. *ICON Health & Fitness, Inc.*, Civil Case No. IPR2017-01407, Provisional Patent Drawings of U.S. Appl. No. 61/786,007, (Patent Owner EX. 2008).
*Nautilus, Inc.* v. *ICON Health & Fitness, Inc.*, Civil Case No. IPR2017-01407, Specification of U.S. Appl. No. 13/754,361 (Patent Owner EX. 2009).
*Nautilus, Inc.* v. *ICON Health & Fitness, Inc.*, Civil Case No. IPR2017-01407, Drawings of U.S. Appl. No. 13/754,361 (Patent Owner EX. 2010).
*Nautilus, Inc.* v. *ICON Health & Fitness, Inc.*, Civil Case No. IPR2017-01407, Webster Dictionary p. 2211 (Merriam-Webster, Inc. 1961, 2002) (EX. 3001).
*Nautilus, Inc.* v. *ICON Health & Fitness, Inc.*, Civil Case No. IPR2017-01408, Patent Owner Preliminary Response to Petition, filed Sep. 5, 2017 (Paper 6).
*Nautilus, Inc.* v. *ICON Health & Fitness, Inc.*, Civil Case No. IPR2017-01408, Decision Institution of Inter Partes Review, filed Dec. 4, 2017 (Paper 7).
*Nautilus, Inc.* v. *ICON Health & Fitness, Inc.*, Civil Case No. IPR2017-01408, Scheduling Order, filed Dec. 4, 2017 (Paper 8).
*Nautilus, Inc.* v. *ICON Health & Fitness, Inc.*, Civil Case No. IPR2017-01408, ORDER Conduct of Proceeding, filed Jan. 19, 2018 (Paper 9).
*Nautilus, Inc.* v. *ICON Health & Fitness, Inc.*, Civil Case No. IPR2017-01408, Patent Owner's Notice of Deposition of R. Lee Rawls, filed Jan. 19, 2018 (Paper 10).
*Nautilus, Inc.* v. *ICON Health & Fitness, Inc.*, Civil Case No. IPR2017-01408, Unopposed Motion for PRO HAC VICE Admission of Tyson Hottinger, filed Feb. 1, 2018 (Paper 11).
*Nautilus, Inc.* v. *ICON Health & Fitness, Inc.*, Civil Case No. IPR2017-01408, Current Exhibit List for Patent Owner, filed Feb. 1, 2018 (Paper 12).
*Nautilus, Inc.* v. *ICON Health & Fitness, Inc.*, Civil Case No. IPR2017-01408, Patent Owner's Updated Notice of Deposition of R. Lee Rawls, Feb. 1, 2018 (Paper 13).
*Nautilus, Inc.* v. *ICON Health & Fitness, Inc.*, Civil Case No. IPR2017-01408, Order Granting Motion for PRO HAC VICE Admission, filed Feb. 12, 2018 (Paper 14).
*Nautilus, Inc.* v. *ICON Health & Fitness, Inc.*, Civil Case No. IPR2017-01408, Petitioner's Updated Mandatory Notices, filed Feb. 20, 2018 (Paper 15).
*Nautilus, Inc.* v. *ICON Health & Fitness, Inc.*, Civil Case No. IPR2017-01408, Petitioner's Updated Power of Attorney, filed Feb. 20, 2018 (Paper 16).
*Nautilus, Inc.* v. *ICON Health & Fitness, Inc.*, Civil Case No. IPR2017-01408, Patent Owners Motion to Amend, filed Mar. 5, 2018 (Paper 17).
*Nautilus, Inc.* v. *ICON Health & Fitness, Inc.*, Civil Case No. IPR2017-01408, Current Exhibit List of Patent Owner, filed Mar. 5, 2018 (Paper 18).
*Nautilus, Inc.* v. *ICON Health & Fitness, Inc.*, Civil Case No. IPR2017-01408, ORDER Conduct of Proceedings, filed Apr. 27, 2018 (Paper 19).
*Nautilus, Inc.* v. *ICON Health & Fitness, Inc.*, Civil Case No. IPR2017-01408, ORDER Conduct of Proceedings, filed May 7, 2018 (Paper 20).
*Nautilus, Inc.* v. *ICON Health & Fitness, Inc.*, Civil Case No. IPR2017-01408, Declaration of Tyson Hottinger in Support of Motion for Admission PRO HAC VICE, (Patent Owner EX. 2001).
*Nautilus, Inc.* v. *ICON Health & Fitness, Inc.*, Civil Case No. IPR2017-01408, Claim Listing of Proposed Substitute Claims for Patent Owner Motion to Amend, (Patent Owner EX. 2002).
*Nautilus, Inc.* v. *ICON Health & Fitness, Inc.*, Civil Case No. IPR2017-01408, Specification of U.S. Appl. No. 15/019,088, (Patent Owner EX. 2003).
*Nautilus, Inc.* v. *ICON Health & Fitness, Inc.*, Civil Case No. IPR2017-01408, Drawings of U.S. Appl. No. 15/019,088, (Patent Owner EX. 2004).
*Nautilus, Inc.* v. *ICON Health & Fitness, Inc.*, Civil Case No. IPR2017-01408, Specification of U.S. Appl. No. 14/213,793, (Patent Owner EX. 2005).
*Nautilus, Inc.* v. *ICON Health & Fitness, Inc.*, Civil Case No. IPR2017-01408, Drawings of U.S. Appl. No. 14/213,793, (Patent Owner EX. 2006).
*Nautilus, Inc.* v. *ICON Health & Fitness, Inc.*, Civil Case No. IPR2017-01408, Specification of Provisional U.S. Appl. No. 61/786,007, (Patent Owner EX. 2007).
*Nautilus, Inc.* v. *ICON Health & Fitness, Inc.*, Civil Case No. IPR2017-01408, Drawings of Provisional U.S. Appl. No. 61/786,007, (Patent Owner EX. 2008).
*Nautilus, Inc.* v. *ICON Health & Fitness, Inc.*, Civil Case No. IPR2017-01408, Specification of U.S. Appl. No. 13/754,361, (Patent Owner EX. 2009).
*Nautilus, Inc.* v. *ICON Health & Fitness, Inc.*, Civil Case No. IPR2017-01408, Drawings of U.S. Appl. No. 13/754,361, (Patent Owner EX. 2010).
*Nautilus, Inc.* v. *ICON Health & Fitness, Inc.*, Civil Case No. IPR2017-01408, Webster Dictionary p. 2211 (Merriam-Webster, Inc. 1961, 2002) (EX. 3001).
*Nautilus, Inc.* v. *ICON Health & Fitness, Inc.*, Civil Case No. IPR2017-01363, Petitioner's Reply in Support of Petition for Inter Partes Review; filed Jun. 4, 2018; 18 pages (paper 21).
*Nautilus, Inc.* v. *ICON Health & Fitness, Inc.*, Civil Case No. IPR2017-01363, Petitioner's Motion for Pro Hac Vice Admission, filed Jun. 6, 2018; 5 pages (paper 22).
*Nautilus, Inc.* v. *ICON Health & Fitness, Inc.*, Civil Case No. IPR2017-01363; Affidavit of Lane M. Polozola in support of Petitioner's Motion of Pro Hac Vice Admission Under 37 C.F.R. 42.10(c), filed Jun. 6, 2018, 4 pages (exhibit 1011).
*Nautilus, Inc.* v. *ICON Health & Fitness, Inc.*, Civil Case No. IPR2017-01363, Order granting Motion for Pro Hac Vice Admission—37 C.F.R. 42.10(c), filed Jun. 14, 2018; 4 pages (paper 23).
*Nautilus, Inc.* v. *ICON Health & Fitness, Inc.*, Civil Case No. IPR2017-01363, Petitioner's Updated Mandatory Notices, filed Jun. 20, 2018; 4 pages (paper 24).
*Nautilus, Inc.* v. *ICON Health & Fitness, Inc.*, Civil Case No. IPR2017-01363, Petitioner's Updated Power of Attorney, filed Jun. 20, 2018; 3 pages (paper 25).
*Nautilus, Inc.* v. *ICON Health & Fitness, Inc.*, Civil Case No. IPR2017-01363, Petitioner's Request for Oral Argument, filed Jul. 25, 2018; 4 pages; (paper 26).

(56) References Cited

OTHER PUBLICATIONS

*Nautilus, Inc.* v. *ICON Health & Fitness, Inc.*, Civil Case No. IPR2017-01363, Patent Owner's Request for Oral Argument, filed Jul. 25, 2018; 4 pages (paper 27).
*Nautilus, Inc.* v. *ICON Health & Fitness, Inc.*, Civil Case No. IPR2017-01363, Order 37 C.F.R. 42.70, filed Aug. 14, 2018, 5 pages (paper 28).
*Nautilus, Inc.* v. *ICON Health & Fitness, Inc.*, Civil Case No. IPR2017-01363, Current Exhibit List of Patent Owner, filed Aug. 24, 2018, 3 pages (paper 29).
*Nautilus, Inc.* v. *ICON Health & Fitness, Inc.*, Civil Case No. IPR2017-01363, Order Conduct of Proceedings 37 C.F.R. 42.5, filed Aug. 24, 2018, 4 pages (paper 30).
*Nautilus, Inc.* v. *ICON Health & Fitness, Inc.*, Civil Case No. IPR2017-01363, Petitioner's Updated Exhibit List, filed Aug. 24, 2018, 4 pages (paper 31).
*Nautilus, Inc.* v. *ICON Health & Fitness, Inc.*, Civil Case No. IPR2017-01363; Petitioner's Oral Argument Demonstrative Exhibits, filed Aug. 24, 2018, 31 pages (exhibit 1012).
*Nautilus, Inc.* v. *ICON Health & Fitness, Inc.*, Civil Case No. IPR2017-01363; Patent Owner Demonstrative Exhibits; filed Aug. 24, 2018, 10 pages (exhibit 2003).
*Nautilus, Inc.* v. *ICON Health & Fitness, Inc.*, Civil Case No. IPR2017-01407, Petitioner's Motion for Pro Hac Vice Admission, filed Jun. 6, 2018, 5 pages (paper 21).
*Nautilus, Inc.* v. *ICON Health & Fitness, Inc.*, Civil Case No. IPR2017-01407, Patent Owner's Objections to Evidence, filed Jun. 7, 2018, 5 pages (paper 22).
*Nautilus, Inc.* v. *ICON Health & Fitness, Inc.*, Civil Case No. IPR2017-01407, Patent Owner's Notice of Deposition of Christopher Cox, filed Jun. 13, 2018, 3 pages (paper 23).
*Nautilus, Inc.* v. *ICON Health & Fitness, Inc.*, Civil Case No. IPR2017-01407, Order—Granting Motion for Pro Hac Vice Admission, filed Jun. 14, 2018, 4 pages (paper 24).
*Nautilus, Inc.* v. *ICON Health & Fitness, Inc.*, Civil Case No. IPR2017-01407, Petitioner's Updated Mandatory Notices, filed Jun. 20, 2018, 4 pages, (paper 25).
*Nautilus, Inc.* v. *ICON Health & Fitness, Inc.*, Civil Case No. IPR2017-01407, Petitioner's Updated Power of Attorney, filed Jun. 20, 2018, 3 pages, (paper 26).
*Nautilus, Inc.* v. *ICON Health & Fitness, Inc.*, Civil Case No. IPR2017-01407, Patent Owner's Reply to Petitioners Opposition to Motions to Amend, filed Jul. 5, 2018, 28 pages, (paper 27).
*Nautilus, Inc.* v. *ICON Health & Fitness, Inc.*, Civil Case No. IPR2017-01407, Current Exhibit List for Patent Owner, filed Jul. 5, 2018, 4 pages, (paper 28).
*Nautilus, Inc.* v. *ICON Health & Fitness, Inc.*, Civil Case No. IPR2017-01407, Patent Owners Updated Mandatory Notices, filed Jul. 5, 2018, 4 pages, (paper 29).
*Nautilus, Inc.* v. *ICON Health & Fitness, Inc.*, Civil Case No. IPR2017-01407, Petitioner's Notice of Deposition Scott Ganaja, filed Jul. 11, 2018, 3 pages (paper 30).
*Nautilus, Inc.* v. *ICON Health & Fitness, Inc.*, Civil Case No. IPR2017-01407, Joint Notice of Stipulation to Modify Scheduling Order, filed Jul. 12, 2018, 3 pages, (paper 31).
*Nautilus, Inc.* v. *ICON Health & Fitness, Inc.*, Civil Case No. IPR2017-01407, Petitioner's Objections to Evidence, filed Jul. 12, 2018, 4 pages (paper 32).
*Nautilus, Inc.* v. *ICON Health & Fitness, Inc.*, Civil Case No. IPR2017-01407, Petitioner's Amended Notice of Deposition Scott Ganaja, filed Jul. 12, 2018, 3 pages (paper 33).
*Nautilus, Inc.* v. *ICON Health & Fitness, Inc.*, Civil Case No. IPR2017-01407, Order Conduct of Proceeding 37 C.F.R. 42.5, filed Jul. 20, 2018, 5 pages, (paper 34).
*Nautilus, Inc.* v. *ICON Health & Fitness, Inc.*, Civil Case No. IPR2017-01407, Petitioner's Sur-Reply ISO Opposition to Motions to Amend, filed Aug. 1, 2018, 19 pages, (paper 35).
*Nautilus, Inc.* v. *ICON Health & Fitness, Inc.*, Civil Case No. IPR2017-01407, Joint Notice of Stipulation to Modify Scheduling Order, filed Aug. 3, 2018, 3 pages (paper 36).
*Nautilus, Inc.* v. *ICON Health & Fitness, Inc.*, Civil Case No. IPR2017-01407, Order Conduct of the Proceeding, filed Aug. 7, 2018, 4 pages (paper 37).
*Nautilus, Inc.* v. *ICON Health & Fitness, Inc.*, Civil Case No. IPR2017-01407, Patent Owner's Objections to Petitioners Sur Reply, filed Aug. 8, 2018, 5 pages (paper 38).
*Nautilus, Inc.* v. *ICON Health & Fitness, Inc.*, Civil Case No. IPR2017-01407, Patent Owner's Request for Oral Argument, filed Aug. 10, 2018, 4 pages , (paper 39).
*Nautilus, Inc.* v. *ICON Health & Fitness, Inc.*, Civil Case No. IPR2017-01407, Petitioner's Request for Oral Argument, filed Aug. 10, 2018, 4 pages, (paper 40).
*Nautilus, Inc.* v. *ICON Health & Fitness, Inc.*, Civil Case No. IPR2017-01407, Patent Owner's Motion to Exclude Evidence, filed Aug. 10, 2018, 11 pages (paper 41).
*Nautilus, Inc.* v. *ICON Health & Fitness, Inc.*, Civil Case No. IPR2017-01407, Order 37 C.F.R. 42.70, filed Aug. 14, 2018, 5 pages (paper 42).
*Nautilus, Inc.* v. *ICON Health & Fitness, Inc.*, Civil Case No. IPR2017-01407, Petitioner's Opposition to Patent Owner's Motion to Exclude, filed Aug. 16, 2018, 18 pages (paper 44).
*Nautilus, Inc.* v. *ICON Health & Fitness, Inc.*, Civil Case No. IPR2017-01407, Patent Owner's Reply in support of Motion to Exclude, filed Aug. 22, 2018, 8 pages, (paper 45).
*Nautilus, Inc.* v. *ICON Health & Fitness, Inc.*, Civil Case No. IPR2017-01407, Current Exhibit List of Patent Owner, filed Aug. 24, 2018, 4 pages (paper 46).
*Nautilus, Inc.* v. *ICON Health & Fitness, Inc.*, Civil Case No. IPR2017-01407, Order re PO Sur-Rebuttal at Hearing, filed Aug. 24, 2018, 4 pages (paper 47).
*Nautilus, Inc.* v. *ICON Health & Fitness, Inc.*, Civil Case No. IPR2017-01407, Exhibit 1012—U.S. Pat. No. 8585561 (Watt), filed Jun. 4, 2018, 32 pages.
*Nautilus, Inc.* v. *ICON Health & Fitness, Inc.*, Civil Case No. IPR2017-01407, Exhibit 1013—U.S. Pat. No. 9044635 (Lull), filed Jun. 4, 2018, 21 pages.
*Nautilus, Inc.* v. *ICON Health & Fitness, Inc.*, Civil Case No. IPR2017-01407, Exhibit 1014—U.S. Pat. No. 7740563 (Dalebout), filed Jun. 4, 2018, 31 pages.
*Nautilus, Inc.* v. *ICON Health & Fitness, Inc.*, Civil Case No. IPR2017-01407, Exhibit 1015—US20020055418A1 (Pyles), filed Jun. 4, 2018, 9 pages.
*Nautilus, Inc.* v. *ICON Health & Fitness, Inc.*, Civil Case No. IPR2017-01407, Exhibit 1016—US20120258433A1 (Hope), filed Jun. 4, 2018, 51 pages.
*Nautilus, Inc.* v. *ICON Health & Fitness, Inc.*, Civil Case No. IPR2017-01407, Exhibit 1017—U.S. Pat. No. 7771320 (Riley), filed Jun. 4, 2018, 44 pages.
*Nautilus, Inc.* v. *ICON Health & Fitness, Inc.*, Civil Case No. IPR2017-01407, Exhibit 1018—Declaration of Christopher Cox in Support of Petitioners Oppositions to Patent Owners Motions to Amend, filed Jun. 4, 2018, 739 pages.
*Nautilus, Inc.* v. *ICON Health & Fitness, Inc.*, Civil Case No. IPR2017-01407, Exhibit 1019—Affidavit of Lane M. Polozola in Support of Petitioners Motion for Pro Hac Vice Admission, filed Jun. 6, 2018, 4 pages.
*Nautilus, Inc.* v. *ICON Health & Fitness, Inc.*, Civil Case No. IPR2017-01407, Exhibit 1020—S. Ganaja Depo Transcript, filed Aug. 1, 2018, 58 pages.
*Nautilus, Inc.* v. *ICON Health & Fitness, Inc.*, Civil Case No. IPR2017-01407, Exhibit 1021—Petitioner's Demonstrative Exhibits, filed Aug. 24, 2018, 92 pages.
*Nautilus, Inc.* v. *ICON Health & Fitness, Inc.*, Civil Case No. IPR2017-01407, Exhibit 2011—Declaration of Scott Ganaja in Support of Patent Owner's Reply to Petitioners Opposition to Patent Owners Motion to Amend, filed Jul. 5, 2018, 42 pages.
*Nautilus, Inc.* v. *ICON Health & Fitness, Inc.*, Civil Case No. IPR2017-01407, Exhibit 2012—Declaration of Richard Ferraro in Support of Patent Owner's Reply to Petitioners Opposition to Patent Owners Motion to Amend, filed Jul. 5, 2018, 35 pages.
*Nautilus, Inc.* v. *ICON Health & Fitness, Inc.*, Civil Case No. IPR2017-01407, Exhibit 2013—Cox, Christopher Depo Transcript 2018 06 26, filed Jul. 5, 2018, 26 pages.

(56) References Cited

OTHER PUBLICATIONS

*Nautilus, Inc.* v. *ICON Health & Fitness, Inc.*, Civil Case No. IPR2017-01407, Exhibit 2014—Patent Owner Demonstrative Exhibits, filed Aug. 24, 2018, 21 pages.
*Nautilus, Inc.* v. *ICON Health & Fitness, Inc.*, Civil Case No. IPR2017-01408, Petitioner's Opposition to Patent Owner's Motion to Amend, filed Jun. 4, 2018, 44 pages (paper 21).
*Nautilus, Inc.* v. *ICON Health & Fitness, Inc.*, Civil Case No. IPR2017-01408, Petitioners Motion for Pro Hac Vice Admission, filed Jun. 6, 2018, 5 pages (paper 22).
*Nautilus, Inc.* v. *ICON Health & Fitness, Inc.*, Civil Case No. IPR2017-01408, Patent Owner's Objections to Evidence, filed Jun. 7, 2018, 5 pages (paper 23).
*Nautilus, Inc.* v. *ICON Health & Fitness, Inc.*, Civil Case No. IPR2017-01408, Declaration R. Lee Rawls, Part 1, dated May 12, 2017, 447 pages, (paper 24).
*Nautilus, Inc.* v. *ICON Health & Fitness, Inc.*, Civil Case No. IPR2017-01408, Declaration R. Lee Rawls, Part 2, dated May 12, 2017, 216 pages, (paper 24).
*Nautilus, Inc.* v. *ICON Health & Fitness, Inc.*, Civil Case No. IPR2017-01408, Order granting Motion for Pro Hac Vice Admission, filed Jun. 14, 2018, 4 pages (paper 25).
*Nautilus, Inc.* v. *ICON Health & Fitness, Inc.*, Civil Case No. IPR2017-01408, Petitioner's Updated Mandatory Notices, filed Jun. 20, 2018, 4 pages, (paper 26).
*Nautilus, Inc.* v. *ICON Health & Fitness, Inc.*, Civil Case No. IPR2017-01408, Petitioner's Updated Power of Attorney, filed Jun. 20, 2018, 3 pages, (paper 27).
*Nautilus, Inc.* v. *ICON Health & Fitness, Inc.*, Civil Case No. IPR2017-01408, Patent Owner's Reply to Opposition to Motions to Amend, filed Jul. 5, 2018, 28 pages, (paper 28).
*Nautilus, Inc.* v. *ICON Health & Fitness, Inc.*, Civil Case No. IPR2017-01408, Current Exhibit List of Patent Owner, filed Jul. 5, 2018, 4 pages, (paper 29).
*Nautilus, Inc.* v. *ICON Health & Fitness, Inc.*, Civil Case No. IPR2017-01408, Patent Owner's Updated Mandatory Notices, filed Jul. 5, 2018, 4 pages, (paper 30).
*Nautilus, Inc.* v. *ICON Health & Fitness, Inc.*, Civil Case No. IPR2017-01408, Petitioner's Notice of Deposition of Scott Ganaja, filed Jul. 11, 2018, 3 pages (paper 31).
*Nautilus, Inc.* v. *ICON Health & Fitness, Inc.*, Civil Case No. IPR2017-01408, Joint Notice of Stipulation to Modify Scheduling Order, filed Jul. 12, 2018, 3 pages (paper 32).
*Nautilus, Inc.* v. *ICON Health & Fitness, Inc.*, Civil Case No. IPR2017-01408, Petitioner's Objections to Patent Owner's Evidence, filed Jul. 12, 2018, 4 pages, (paper 33).
*Nautilus, Inc.* v. *ICON Health & Fitness, Inc.*, Civil Case No. IPR2017-01408, Petitioner's Amended Notice of Deposition of Scott Ganaja, filed Jul. 12, 2018, 3 pages, (paper 34).
*Nautilus, Inc.* v. *ICON Health & Fitness, Inc.*, Civil Case No. IPR2017-01408, Order - Conduct of the Proceeding, 37 C.F.R. 42.5, filed Jul. 20, 2018, 5 pages (paper 35).
*Nautilus, Inc.* v. *ICON Health & Fitness, Inc.*, Civil Case No. IPR2017-01408, Petitioner's Sur-Reply in Support of Opposition to Patent Owners Motions to Amend, filed Aug. 1, 2018, 19 pages, (paper 36).
*Nautilus, Inc.* v. *ICON Health & Fitness, Inc.*, Civil Case No. IPR2017-01408, Joint Notice of Stipulation to Modify Scheduling Order, filed Aug. 3, 2018, 3 pages (paper 37).
*Nautilus, Inc.* v. *ICON Health & Fitness, Inc.*, Civil Case No. IPR2017-01408, Order—Conduct of the Proceeding, 37 C.F.R. 42.5, filed Aug. 7, 2018, 4 pages (paper 38).
*Nautilus, Inc.* v. *ICON Health & Fitness, Inc.*, Civil Case No. IPR2017-01408, Patent Owner's Objections to Petitioners Sur Reply, filed Aug. 2, 2018, 5 pages, (paper 39).
*Nautilus, Inc.* v. *ICON Health & Fitness, Inc.*, Civil Case No. IPR2017-01408, Patent Owner's Request for Oral Argument, filed Aug. 10, 2018, 4 pages, (paper 40).
*Nautilus, Inc.* v. *ICON Health & Fitness, Inc.*, Civil Case No. IPR2017-01408, Petitioner's Request for Oral Argument, filed Aug. 10, 2018, 4 pages, (paper 41).
*Nautilus, Inc.* v. *ICON Health & Fitness, Inc.*, Civil Case No. IPR2017-01408, Patent Owner's Motion to Exclude Evidence, filed Aug. 10, 2018, 11 pages (paper 42).
*Nautilus, Inc.* v. *ICON Health & Fitness, Inc.*, Civil Case No. IPR2017-01408, Order-Oral Hearing 37 C.F.R. 42.70, filed Aug. 14, 2018, 5 pages (paper 43).
*Nautilus, Inc.* v. *ICON Health & Fitness, Inc.*, Civil Case No. IPR2017-01408, Petitioner's Opposition to Patent Owner's Motion to Exclude Evidence, filed Aug. 16, 2018, 18 pages (paper 44).
*Nautilus, Inc.* v. *ICON Health & Fitness, Inc.*, Civil Case No. IPR2017-01408, Patent Owners Reply in Support of its Motion to Exclude, filed Aug. 22, 2018, 8 pages, (paper 46).
*Nautilus, Inc.* v. *ICON Health & Fitness, Inc.*, Civil Case No. IPR2017-01408, Current Exhibit List of Patent Owner, filed Aug. 24, 2018, 4 pages (paper 47).
*Nautilus, Inc.* v. *ICON Health & Fitness, Inc.*, Civil Case No. IPR2017-01408, Order Conduct of the Proceedings—37 C.F.R. 42.5, filed Aug. 24, 2018, 4 pages, (paper 48).
*Nautilus, Inc.* v. *ICON Health & Fitness, Inc.*, Civil Case No. IPR2017-01408, Petitioner's Updated Exhibit List, filed Aug. 24, 2018, 5 pages, (paper 49).
*Nautilus, Inc.* v. *ICON Health & Fitness, Inc.*, Civil Case No. IPR2017-01408, Exhibit 1012—U.S. Pat. No. 8585561 (Watt), filed Jun. 4, 2018, 32 pages.
*Nautilus, Inc.* v. *ICON Health & Fitness, Inc.*, Civil Case No. IPR2017-01408, Exhibit 1013—U.S. Pat. No. 9044635 (Lull), filed Jun. 4, 2018, 21 pages.
*Nautilus, Inc.* v. *ICON Health & Fitness, Inc.*, Civil Case No. IPR2017-01408, Exhibit 1014—U.S. Pat. No. 7740563 (Dalebout), filed Jun. 4, 2018, 31 pages.
*Nautilus, Inc.* v. *ICON Health & Fitness, Inc.*, Civil Case No. IPR2017-01408, Exhibit 1015—U.S. Pat. No. 20020055418A1 (Pyles), filed Jun. 4, 2018, 9 pages.
*Nautilus, Inc.* v. *ICON Health & Fitness, Inc.*, Civil Case No. IPR2017-01408, Exhibit 1016—U.S. Pat. No. 20120258433A1 (Hope), filed Jun. 4, 2018, 51 pages.
*Nautilus, Inc.* v. *ICON Health & Fitness, Inc.*, Civil Case No. IPR2017-01408, Exhibit 1017—U.S. Pat. No. 7771320 (Riley), filed Jun. 4, 2018, 44 pages.
*Nautilus, Inc.* v. *ICON Health & Fitness, Inc.*, Civil Case No. IPR2017-01408, Exhibit 1018—Declaration of Christopher Cox in Support of Petitioners Oppositions to Patent Owners Motions to Amend, filed Jun. 4, 2018, 739 pages.
*Nautilus, Inc.* v. *ICON Health & Fitness, Inc.*, Civil Case No. IPR2017-01408, Exhibit 1019—Affidavit of Lane M. Polozola in Support of Petitioners Motion for Pro Hac Vice Admission, filed Jun. 6, 2018, 4 pages.
*Nautilus, Inc.* v. *ICON Health & Fitness, Inc.*, Civil Case No. IPR2017-01408, Exhibit 1020—Scott Ganaja Depo Transcript, filed Aug. 1, 2018, 58 pages.
*Nautilus, Inc.* v. *ICON Health & Fitness, Inc.*, Civil Case No. IPR2017-01408, Exhibit 1021—Petitioner's Demonstrative Exhibits, filed Aug. 24, 2018, 92 pages.
*Nautilus, Inc.* v. *ICON Health & Fitness, Inc.*, Civil Case No. IPR2017-01408, Exhibit 2011—Declaration of Scott Ganaja in Support of Patent Owner's Reply to Petitioner's Opposition to Patent Owner's Motion to Amend, filed Jul. 5, 2018, 42 pages.
*Nautilus, Inc.* v. *ICON Health & Fitness, Inc.*, Civil Case No. IPR2017-01408, Exhibit 2012—Declaration of Richard Ferraro in Support of Patent Owner's Reply to Petitioner's Opposition to Patent Owner's Motion to Amend, filed Jul. 5, 2018, 35 pages.
*Nautilus, Inc.* v. *ICON Health & Fitness, Inc.*, Civil Case No. IPR2017-01408, Exhibit 2013—Cox, Christopher Depo Transcript Jun. 26, 2018, filed Jul. 5, 2018, 26 pages.
*Nautilus, Inc.* v. *ICON Health & Fitness, Inc.*, Civil Case No. IPR2017-01408, Exhibit 2014—Patent Owner's Demonstrative Exhibits, filed Aug. 24, 2018, 21 pages.
European Patent Office, Article 94(3) EPC Communication dated Jul. 10, 2018, issued in European Patent Application No. 14768130.8-1126, 3 pages.

(56) References Cited

OTHER PUBLICATIONS

United States Patent and Trademark Office; International Search Report and Written Opinion issued in application No. PCT/US2015/034665; dated Oct. 8, 2015 (14 pages).
*Nautilus, Inc.* v. *ICON Health & Fitness, Inc.*, Civil Case No's. IPR2017-01363, IPR2017-01407, and IPR2017-01408 Record of Oral Hearing held Aug. 29, 2018; (paper 32) 104 pages.
*Nautilus, Inc.* v. *ICON Health & Fitness, Inc.*, Civil Case No. IPR2017-01407—Petitioner's Updated Exhibit List, filed Aug. 24, 2018, (paper 48) 5 pages.
*Nautilus, Inc.* v. *ICON Health & Fitness, Inc.*, Civil Case No. IPR2017-01363, Final Written Decision dated Nov. 28, 2018; (paper 33) 29 pages.
*Nautilus, Inc.* v. *ICON Health & Fitness, Inc.*, Civil Case No's. IPR2017-01407, Final Written Decision dated Dec. 3, 2018; (paper 50) 81 pages.
*Nautilus, Inc.* v. *ICON Health & Fitness, Inc.*, Civil Case No's. IPR2017-01408, Final Written Decision dated Dec. 3, 2018; (paper 51) 82 pages.
U.S. Appl. No. 16/572,272; filed Sep. 16, 2019, titled "Cable Exercise Machine", (35 pages).
U.S. Appl. No. 62/310,467, filed Mar. 18, 2016, titled "Collapsible Strength Exercise Machine", 31 pages.
U.S. Appl. No. 62/429,977 filed Dec. 5, 2016, titled "Pull Cable Resistance Mechanism in a Treadmill", 37 pages.
U.S. Appl. No. 62/429,970 filed Dec. 5, 2016, titled "Tread Belt Locking Mechanism", 37 pages.
International Bureau of Wipo; International Preliminary Report on Patentability; Int'l App No. PCT/US2017/064523 dated Jun. 11, 2019; 7 pages.
International Bureau of Wipo; International Preliminary Report on Patentability; Int'l App No. PCT/US2017/064536 dated Jun. 11, 2019; 8 pages.
Chinese Second Office Action for Chinese Patent Application No. 201480003701.9 dated Nov. 21, 2016.
Chinese Third Office Action for Chinese Patent Application No. 201480003701.9 dated Nov. 24, 2017.
Chinese Office Action for Chinese Patent Application No. 201580033332 dated Feb. 28, 2018.
Chinese Second Office Action for Chinese Patent Application No. 201580033332 dated Nov. 15, 2018.
Nordic Track Fusion CST Series; website; located at: http://www/nordictrack.com/fusion-cst-series; accessed on Jan. 24, 2018; 11 pages.
U.S. Appl. No. 62/804,146, filed Feb. 11, 2019, titled Cable and Power Rack Exercise Machine, 49 pages.
U.S. Appl. No. 16/787,850, filed Feb. 11, 2020, titled Exercise Machine, 40 pages.
International Patent Application No. PCT/US20/17710, filed Feb. 11, 2020, titled Exercise Machine, 41 pages.
First Office Action and Search Report with English translation issued in Taiwan application 106135830 dated Jun. 15, 2018.
United States U.S. Appl. No. 16/742,762, filed Jan. 14, 2020, titled Controlling an Exercise Machine Using a Video Workout Program, 146 pages.
United States U.S. Appl. No. 16/750,925, filed Jan. 2, 2020, titled Systems and Methods for an Interactive Pedaled Exercise Device, 54 pages.
U.S. Appl. No. 62/914,007, filed Oct. 11, 2019, titled Modular Exercise Device, 128 pages.
U.S. Appl. No. 62/934,291, filed Nov. 12, 2019, titled Exercise Storage System, 41 pages.
U.S. Appl. No. 62/934,297, filed Nov. 12, 2019, titled Exercise Storage System, 44 pages.
Extended European Search Report for European Application No. 178791802, dated Jun. 9, 2020, 8 pages.
Chinese First Office Action for Application No. 201780074846.1 dated May 9, 2020, 2 pages.
U.S. Appl. No. 29/702,127, dated Sep. 16, 2019, Gordon Cutler.
U.S. Appl. No. 13/088,007, dated Apr. 15, 2018, Scott R. Watterson.
U.S. Appl. No. 15/973,176, dated Jun. 7, 2018, Melanie Douglass.
U.S. Appl. No. 16/742,762, dated Jan. 14, 2020, Eric W. Watterson.
U.S. Appl. No. 16/750,925, dated Jan. 25, 2019, Ryan Silcock.
U.S. Appl. No. 16/797,850, dated Feb. 11, 2020, Scott R. Watterson.
U.S. Appl. No. 62/852,118, dated May 22, 2019, David Hays.
U.S. Appl. No. 62/887,391, dated Aug. 15, 2019, Gaylen Ercanbrack.
U.S. Appl. No. 62/887,398, dated Aug. 15, 2019, William T. Dalebout.
U.S. Appl. No. 62/897,113, dated Sep. 9, 2019, Megan Jane Ostler.
U.S. Appl. No. 62/914,007, dated Oct. 11, 2019, Jared Willardson.
U.S. Appl. No. 62/934,291, dated Nov. 12, 2019, William T. Dalebout.
U.S. Appl. No. 62/934,297, dated Nov. 12, 2019, William T. Dalebout.
First Office Action and Search Report issued in Chinese patent application No. 201480003701 dated Apr. 6, 2016.
Second Office Action and Search Report issued in Chinese patent application No. 201480003701 dated Nov. 21, 2016.
Third Office Action issued in Chinese patent application No. 201480003701 dated Feb. 6, 2017 (English Translation only).
European Search Report and Office Action issued in application EP14768130 dated Oct. 19, 2016.
Written Opinion and International Search Report issued in PCT/US2014/029353 dated Aug. 4, 2014.
First Office Action and Search Report issued in Chinese patent application No. 2014800708329 dated Jun. 2, 2017.
European Search Report and Office Action issued in application EP14874303 dated May 22, 2017.
First Office Action and Search Report issued in Chinese patent application No. 201580033332.2 dated Feb. 8, 2018.
Second Office Action and Search Report issued in Chinese patent application No. 201580033332.2 dated Nov. 15, 2 018.
English translation of Office Action and Search Report issued in Taiwan application 104118641 dated Aug. 12, 2016.
Written Opinion and International Search Report issued in PCT/US2015/034665 dated Oct. 8, 2015.
English translation of Office Action and Search Report issued in Taiwan application 106135830 dated Jun. 15, 2018.
Written Opinion and International Search Report issued in PCT/US2017/064536 dated Mar. 22, 2018.
International Search Report and Written Opinion dated Aug. 20, 2020 issued in International Application No. PCT/US20/17710, 10 pages.
European Extended Search Report dated Dec. 20, 2019 issued in Application No. 19205866.7.
International Search Report & Written Opinion for PCT Application No. PCT/US2014/072390, dated Mar. 27, 2014, 9 pages.

* cited by examiner

CABLE AND POWER RACK EXERCISE MACHINE

CROSS-REFERENCE TO RELATED APPLICATIONS

This application claims priority to provisional patent application No. 62/804,146 entitled "CABLE AND POWER RACK EXERCISE MACHINE" filed Feb. 11, 2019, which application is herein incorporated by reference for all that it discloses.

BACKGROUND

A cable exercise machine is a popular piece of exercise equipment for improving muscular definition and strength. Some benefits of a cable exercise machine are that it may enable a user to easily isolate muscles. However, use of a cable exercise machine may result in individual muscles becoming stronger while other muscles are left weak. This may be due to the cable exercise machine adjusting, balancing, and supporting the user's body, resulting in weaker muscles that would normally do these tasks in real life.

Free weights are also popular for improving muscular definition and strength. In contrast to using a cable exercise machine, using free weights tends to require a user to use more than one muscle group for each exercise, and may generally result in less muscle isolation.

The subject matter claimed herein is not limited to embodiments that solve any disadvantages or that operate only in environments such as those described above. Rather, this background is only provided to illustrate one example technology area where some embodiments described herein may be practiced.

SUMMARY

In one aspect of the disclosure, an exercise machine may include a frame, a resistance mechanism supported by the frame, a first pull cable and a second pull cable supported by the frame and linked to the resistance mechanism, and a power rack attached to the frame. The power rack may include a first upright post configured to have a first barbell holder adjustably attached thereto and a second upright post configured to have a second barbell holder adjustably attached thereto. The first barbell holder may be adjusted in various positions between a first highest position and a first lowest position on the first upright post. The second barbell holder may also be adjusted in various positions between a second highest position and a second lowest position on the second upright post.

Another aspect of the disclosure may include any combination of the above-mentioned features and may further include a first tensioner spring configured to reduce slack in the first pull cable, and a second tensioner spring configured to reduce slack in the second pull cable.

Another aspect of the disclosure may include any combination of the above-mentioned features and may further include a first pulley configured to selectively receive the first pull cable to enable the first pull cable to be selectively attached to a barbell to enable the first tensioner spring to assist a user in lifting the barbell, and a second pulley configured to selectively receive the second pull cable to enable the second pull cable to be selectively attached to the barbell to enable the second tensioner spring to assist the user in lifting the barbell.

Another aspect of the disclosure may include any combination of the above-mentioned features and may further include the first tensioner spring being configured to provide between 3-5 pounds, between 2-8 pounds, between 1-11 pounds, or between 2-20 pounds of force assisting the user in lifting the barbell, and the second tensioner spring being configured to provide between 3-5 pounds, between 2-8 pounds, between 1-11 pounds, or between 2-20 pounds of force assisting the user in lifting the barbell.

Another aspect of the disclosure may include any combination of the above-mentioned features and may further include a first tensioner spring configured to reduce slack in the first pull cable, a second tensioner spring configured to reduce slack in the second pull cable, a first pulley configured to selectively receive the first pull cable to enable the first pull cable to be selectively attached to a barbell to enable the first tensioner spring to hinder a user in lifting the barbell, and a second pulley configured to selectively receive the second pull cable to enable the second pull cable to be selectively attached to the barbell to enable the second tensioner spring to hinder the user in lifting the barbell.

Another aspect of the disclosure may include any combination of the above-mentioned features and may further include the first tensioner spring being configured to provide between 3-5 pounds, between 2-8 pounds, between 1-11 pounds, or between 2-20 pounds of force hindering the user in lifting the barbell, and the second tensioner spring being configured to provide between 3-5 pounds, between 2-8 pounds, between 1-11 pounds, or between 2-20 pounds of force hindering the user in lifting the barbell.

Another aspect of the disclosure may include any combination of the above-mentioned features and may further include the resistance mechanism being configured to be selectively set at one of multiple resistance levels, and the first pulley and the second pulley enabling the resistance mechanism to hinder the user in lifting the barbell in proportion to the set resistance level of the resistance mechanism.

Another aspect of the disclosure may include any combination of the above-mentioned features and may further include the resistance mechanism including a flywheel and one or more magnets arranged to selectively resist rotation of the flywheel.

Another aspect of the disclosure may include any combination of the above-mentioned features and may further include the resistance mechanism including a motor.

Another aspect of the disclosure may include any combination of the above-mentioned features and may further include a motor supported by the frame and linked to the first pull cable and to the second pull cable, a first pulley configured to selectively receive the first pull cable to enable the first pull cable to be selectively attached to a barbell to enable the motor to assist a user in lifting the barbell, and a second pulley configured to selectively receive the second pull cable to enable the second pull cable to be selectively attached to the barbell to enable the motor to assist the user in lifting the barbell.

Another aspect of the disclosure may include any combination of the above-mentioned features and may further include the power rack further including a pull-up bar supported by the first upright post and by the second upright post.

Another aspect of the disclosure may include any combination of the above-mentioned features and may further include the power rack further including a first weight plate holder supported by the first upright post, and a second weight plate holder supported by the second upright post.

Another aspect of the disclosure may include any combination of the above-mentioned features and may further include the first barbell holder and the second barbell holder being configured as spotter arms to prevent a barbell from falling on a user if the user is unable to continue lifting the barbell.

Another aspect of the disclosure may include any combination of the above-mentioned features and may further include one or more dumbbell racks supported by the frame and each configured to hold a dumbbell.

In another aspect of the disclosure, an exercise machine may include a frame, a resistance mechanism supported by the frame, a first pull cable and a second pull cable supported by the frame and linked to the resistance mechanism, and a bottom-out mechanism configured to prevent the first pull cable and the second pull cable from being fully extended.

Another aspect of the disclosure may include any combination of the above-mentioned features and may further include the bottom-out mechanism including a first visual indicator on the first pull cable and a second visual indicator on the second pull cable.

Another aspect of the disclosure may include any combination of the above-mentioned features and may further include the bottom-out mechanism including a sensor configured to trigger when one or more of the first pull cable and/or the second pull cable has been extended to within a threshold of being fully extended, a user has moved past a threshold distance from the exercise machine, or a barbell has moved past a threshold distance from the exercise machine.

Another aspect of the disclosure may include any combination of the above-mentioned features and may further include the bottom-out mechanism further including an alarm configured, in response to the sensor triggering, to alert the user of a danger of the first pull cable and/or the second pull cable being fully extended.

Another aspect of the disclosure may include any combination of the above-mentioned features and may further include the bottom-out mechanism further including one or more brakes configured, in response to the sensor triggering, to engage the first pull cable and/or the second pull cable to prevent the first pull cable and/or the second pull cable from being fully extended.

Another aspect of the disclosure may include any combination of the above-mentioned features and may further include the sensor including one or more of an optical sensor, a magnetic sensor, a camera sensor, or an infrared sensor.

Another aspect of the disclosure may include any combination of the above-mentioned features and may further include the exercise machine further including a power rack attached to the frame and configured to have a first barbell holder and a second barbell holder adjustably attached thereto, the exercise machine further including a first tensioner spring configured to reduce slack in the first pull cable, the exercise machine further comprises a second tensioner spring configured to reduce slack in the second pull cable, the exercise machine further including a first pulley configured to selectively receive the first pull cable to enable the first pull cable to be selectively attached to a barbell to enable the first tensioner spring to assist a user in lifting the barbell, the exercise machine further including a second pulley configured to selectively receive the second pull cable to enable the second pull cable to be selectively attached to the barbell to enable the second tensioner spring to assist the user in lifting the barbell, and the bottom-out mechanism being further configured to prevent the first pull cable and the second pull cable from being fully extended to avoid a user of the barbell, with the first pull cable and the second pull cable selectively attached thereto, from being prevented from moving a muscle group through a full range of motion while lifting the barbell.

It is to be understood that both the foregoing summary and the following detailed description are explanatory and are not restrictive of the invention as claimed.

BRIEF DESCRIPTION OF THE DRAWINGS

Embodiments will be described and explained with additional specificity and detail through the use of the accompanying drawings in which.

Throughout the drawings, identical reference numbers designate similar, but not necessarily identical, elements.

DETAILED DESCRIPTION

Figure 1A:
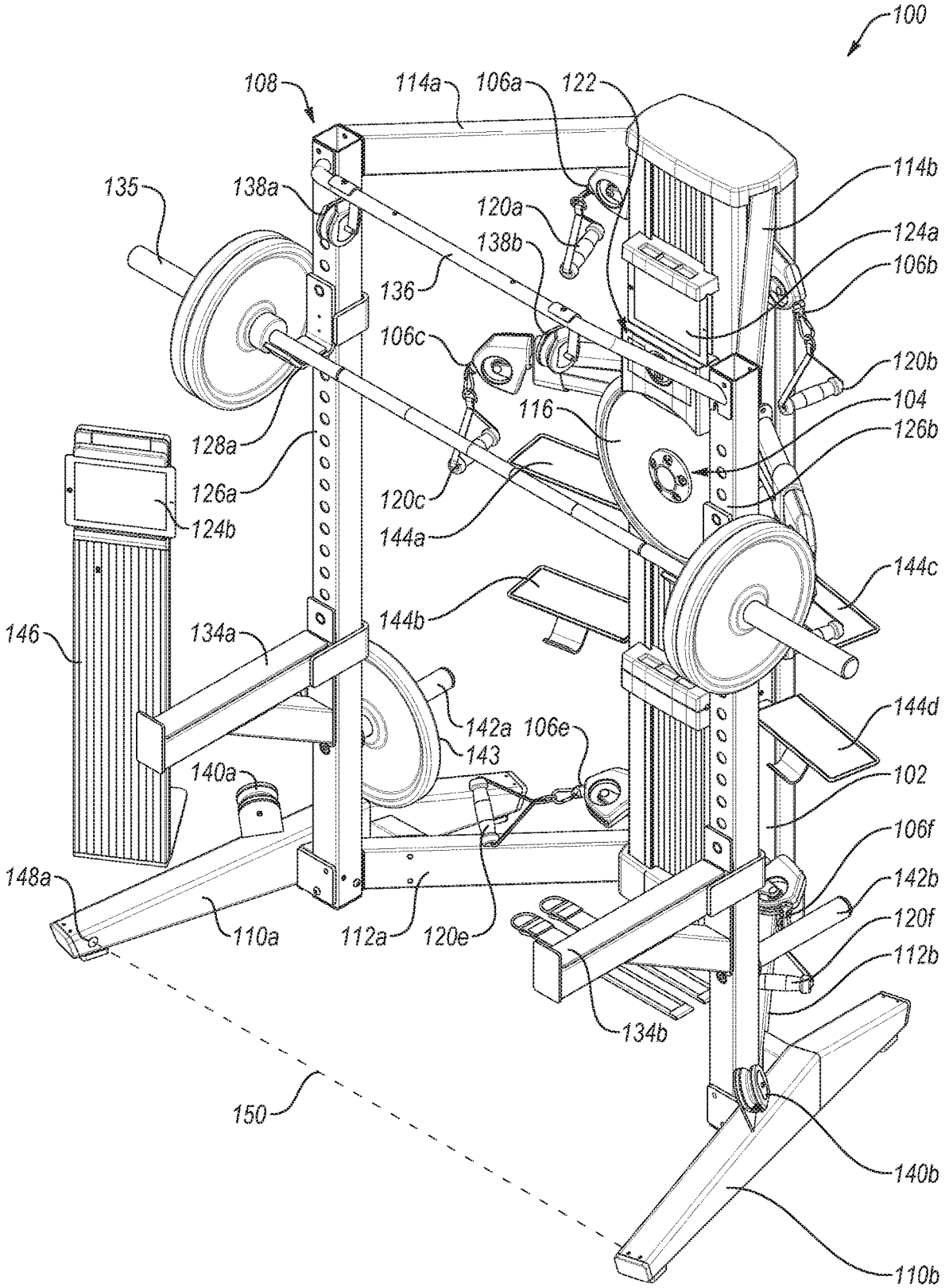
FIGS. 1A-1E are front-right, front, right, rear, and top views, respectively, of an example cable and power rack exercise machine.
Figure 1B:
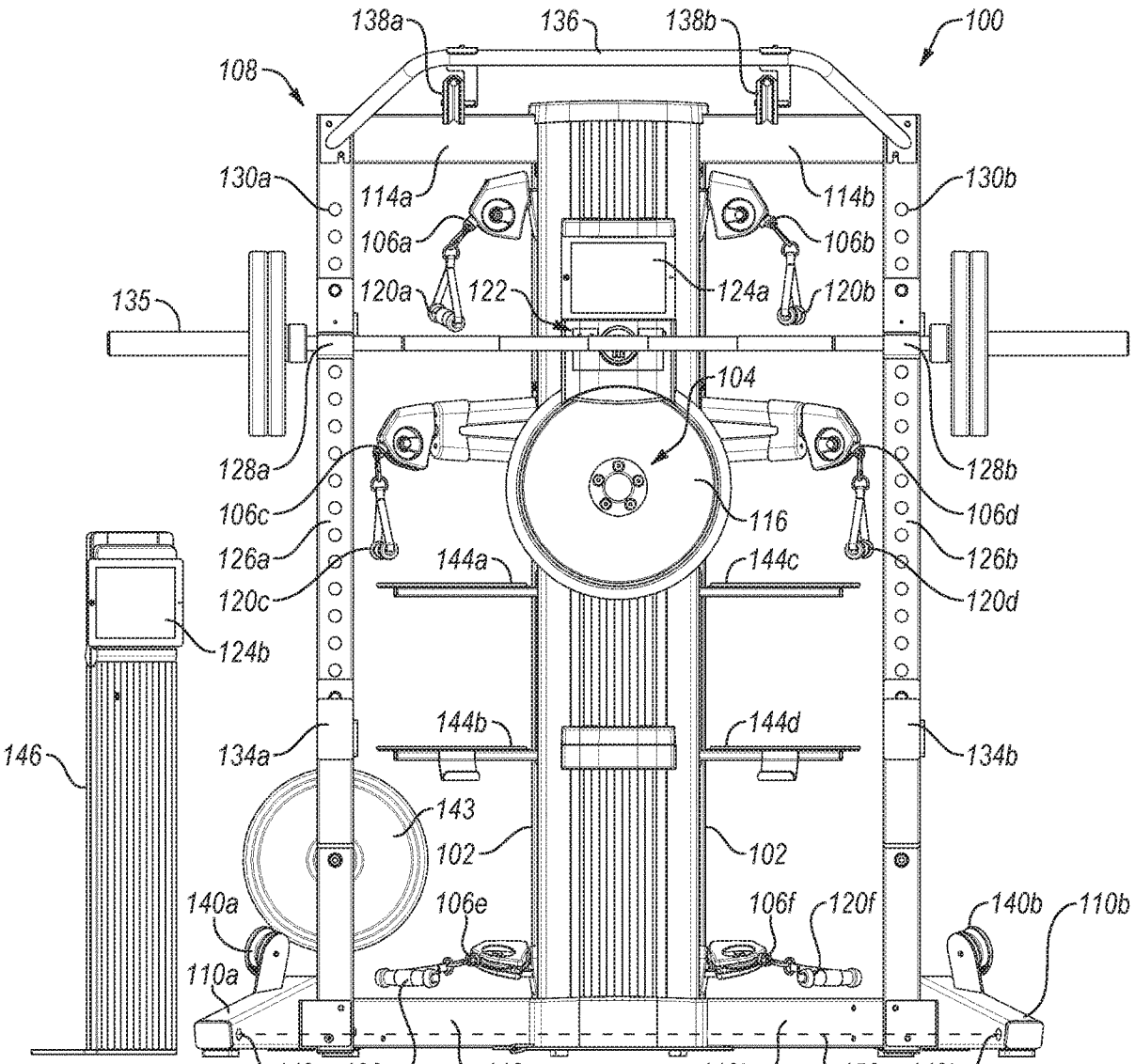

Some embodiments disclosed herein include a cable and power rack exercise machine. For example, the example exercise machine disclosed herein may combine features of a cable machine and features of a power rack to yield a superior exercise machine where cables of the exercise machine can be attached to a barbell to assist the user in performing a workout with the barbell. This assistance may come in the form of making the barbell easier to lift or harder to lift, depending on the desired effect. The exercise machine may also include certain bottom-out features that prevent the cables from being fully extended in order to maintain the effective assistance of the cables while pulling on the cables alone or when the cables are attached to the barbell. In this manner, the example exercise machine disclosed herein may enable a user to perform both cable exercises as well as free weight exercises.

Turning now to the drawings, 1A-1E are front-right, front, right, rear, and top views, respectively, of an example cable and power rack exercise machine. The exercise machine 100 may include a frame 102, a resistance mechanism 104 supported by the frame 102, and pull cables 106*a*-106*f* supported by the frame 102 and linked to the resistance mechanism 104, and a power rack 108 attached to the frame 102.

The frame 102 may be supported by a base that may include left and right legs 110*a* and 110*b* and left and right lower supports 112*a* and 112*b*. The frame may also include left and right upper supports 114*a* and 114*b*.

The resistance mechanism 104 may include a flywheel 116 and one or more magnets 118 arranged to selectively resist rotation of the flywheel 116 (which may be either permanent magnets configured to be repositioned or electromagnets configured to have magnetic strength adjusted). The pull cables 106*a*-106*f* may have handles 120*a*-120*f* attached thereto, respectively, such that a user can pull on any of the pull cables 106*a*-106*f* by pulling on the corresponding handle 120*a*-120*f*. The pull cables 106*a*-106*f* may be linked to the resistance mechanism 104, via multiple pulleys, spools, other cables, etc, such that the resistance mechanism 104 can apply a set level of resistance to a user pulling on any one of the pull cables 106*a*-106*f*. The level of resistance applied by the resistance mechanism 104 may be at least partially controlled by a console 122, and/or may be at least partially controlled by a tablet 124*a* or 124*b* that is in wired or wireless communication (e.g., Bluetooth communication) with the console 122.

The pull cables 106*a*-106*f* may be further linked to left and right tensioner springs 125*a* and 125*b* that are configured to reduce slack in the pull cables 106*a*-106*f*. More particularly, the left tensioner spring 125*a* may be configured to reduce slack in the left-side pull cables 106*a*, 106*c*, and 106*e*, while the right tensioner spring 125*b* may be configured to reduce slack in the right-side pull cables 106*b*, 106*d*, and 106*f*. For example, after a user pulls on one of the pull cables 106*a*-106*f*, the left tensioner spring 125*a* or the right tensioner spring 125*b* may be configured to retract the pull cable back to its fully-retracted position.

The power rack 108 may include left and right upright posts 126*a* and 126*b* that are attached to the frame 102 via the left and right lower supports 112*a* and 112*b* and the left and right upper supports 114*a* and 114*b*, respectively. The left and right upright posts 126*a* and 126*b* may be configured to have left and right barbell holders 128*a* and 128*b*, respectively, adjustably attached thereto. The left and right barbell holders 128*a* and 128*b* may be adjusted in various positions between left and right highest positions 130*a* and 130*b* and left and right lowest positions 132*a* and 132*b* on the left and right upright posts 126*a* and 126*b*, respectively. The left and right upright posts 126*a* and 126*b* may be configured to have left and right spotter arms 134*a* and 134*b*, respectively, adjustably attached thereto. The left and right spotter arms 134*a* and 134*b* may also be adjusted in various positions between the left and right highest positions 130*a* and 130*b* and the left and right lowest positions 132*a* and 132*b* on the left and right upright posts 126*a* and 126*b*, respectively. The left and right barbell holders 128*a* and 128*b* and/or the left and right spotter arms 134*a* and 134*b* may be configured to prevent a barbell 135 from falling on a user if the user is unable to continue lifting the barbell 135.

The power rack 108 may further include a pull-up bar 136 supported by the left and right upright posts 126*a* and 126*b*. The pull-up bar 136 may be configured to allow a user to perform pull-ups on the power rack 108. The power rack 108 may further include left and right upper pulleys 138*a* and 138*b* supported by the pull-up bar 136 and left and right lower pulleys 140*a* and 140*b* supported by the left and right legs 110*a* and 110*b*, respectively. The power rack 108 may further include left and right weight plate holders 142*a* and 142*b* supported by the left and right upright posts 126*a* and 126*b* configured for storage of weight plates, such as the weight plate 143. The power rack 108 may further include dumbbell racks 144*a*-144*d* supported by the frame 102 and each configured to hold a dumbbell (not shown).

The exercise machine 100 may further include a tablet holder 146 configured to hold the tablet 124*a*, or to hold a second tablet 124*b*, so that when the user is faced away from the console 122, and/or from the tablet 124*a* mounted above the console 122, the user may continue to view a tablet connected to the console 122 of the exercise machine 100, and to control the exercise machine 100 using the tablet, without having to turn around.

Figure 1C:
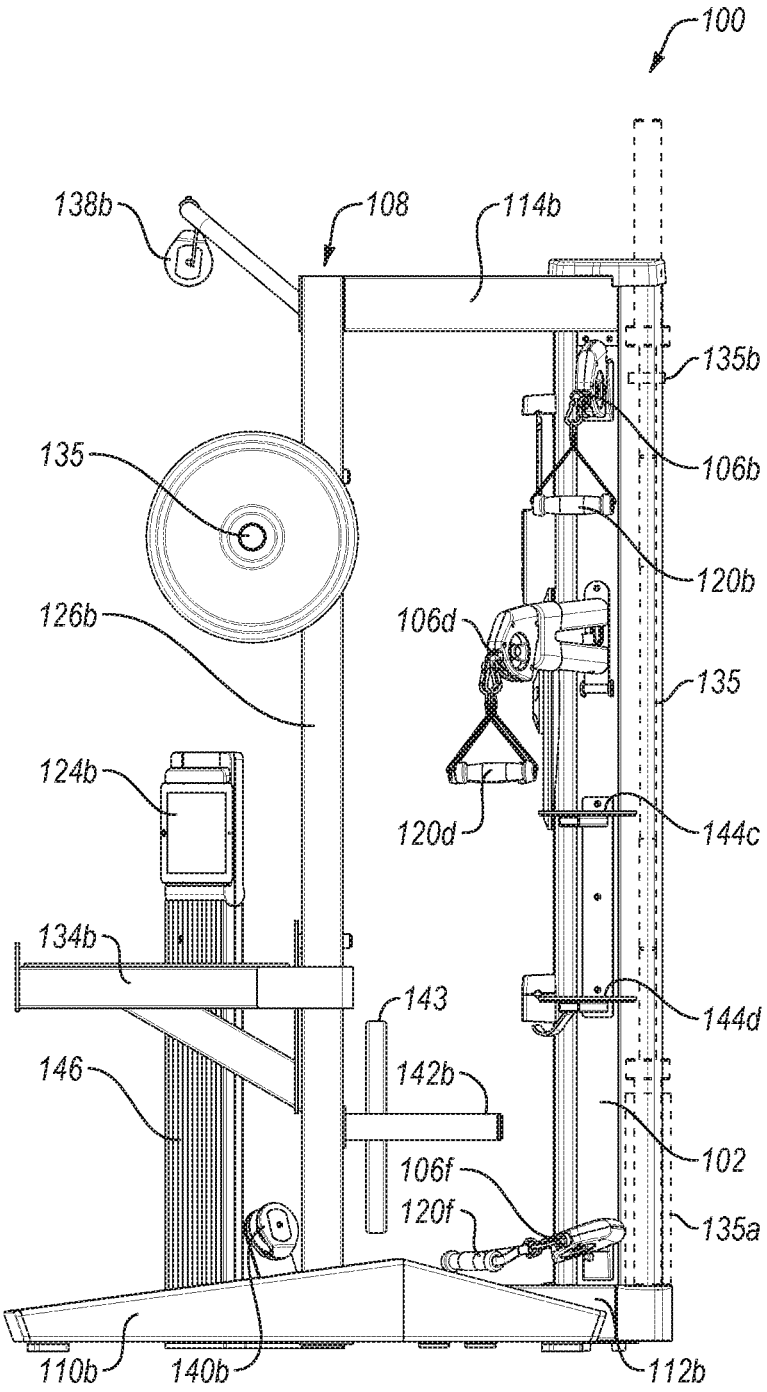
Figure 1D:
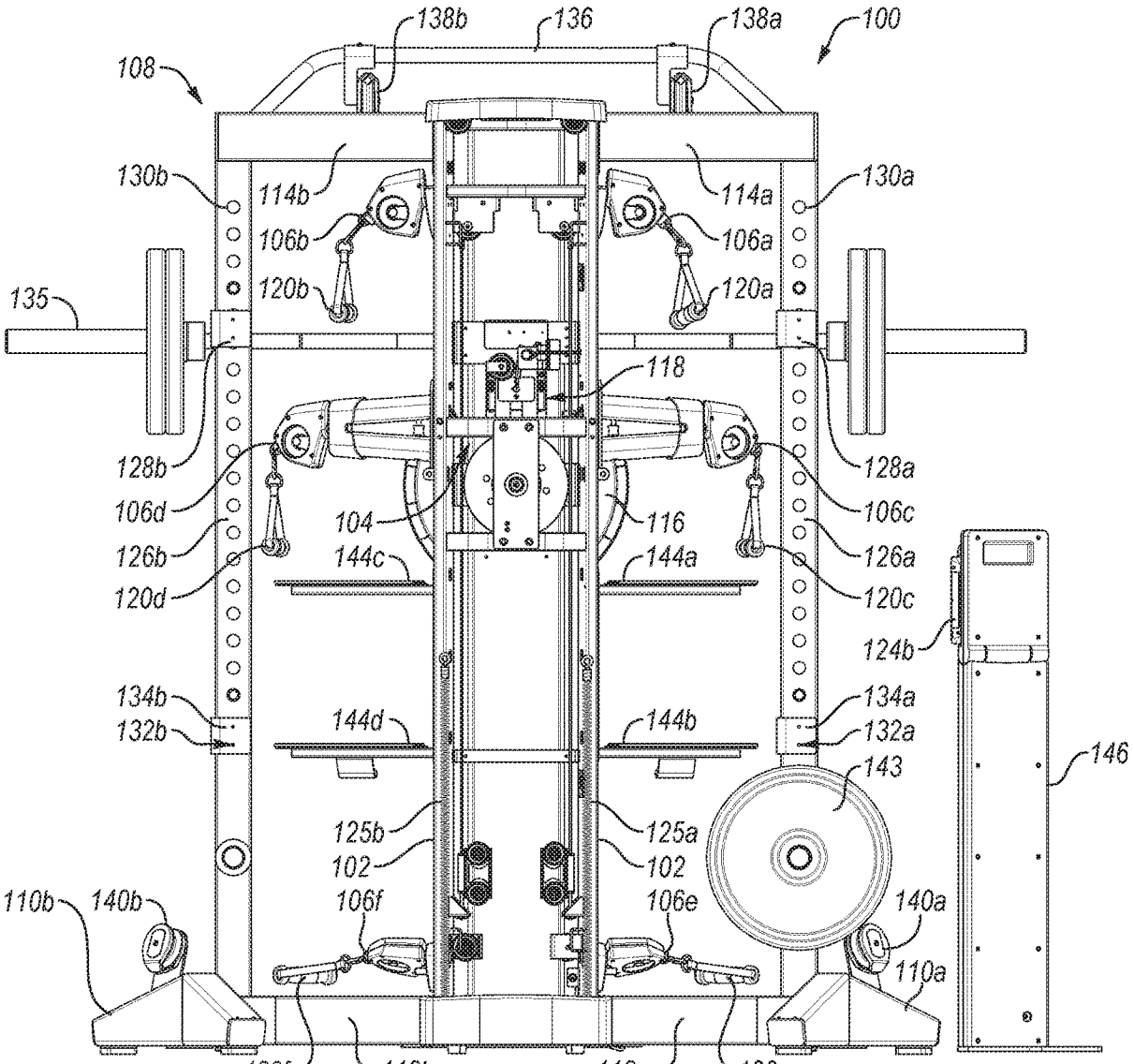
Figure 1E:
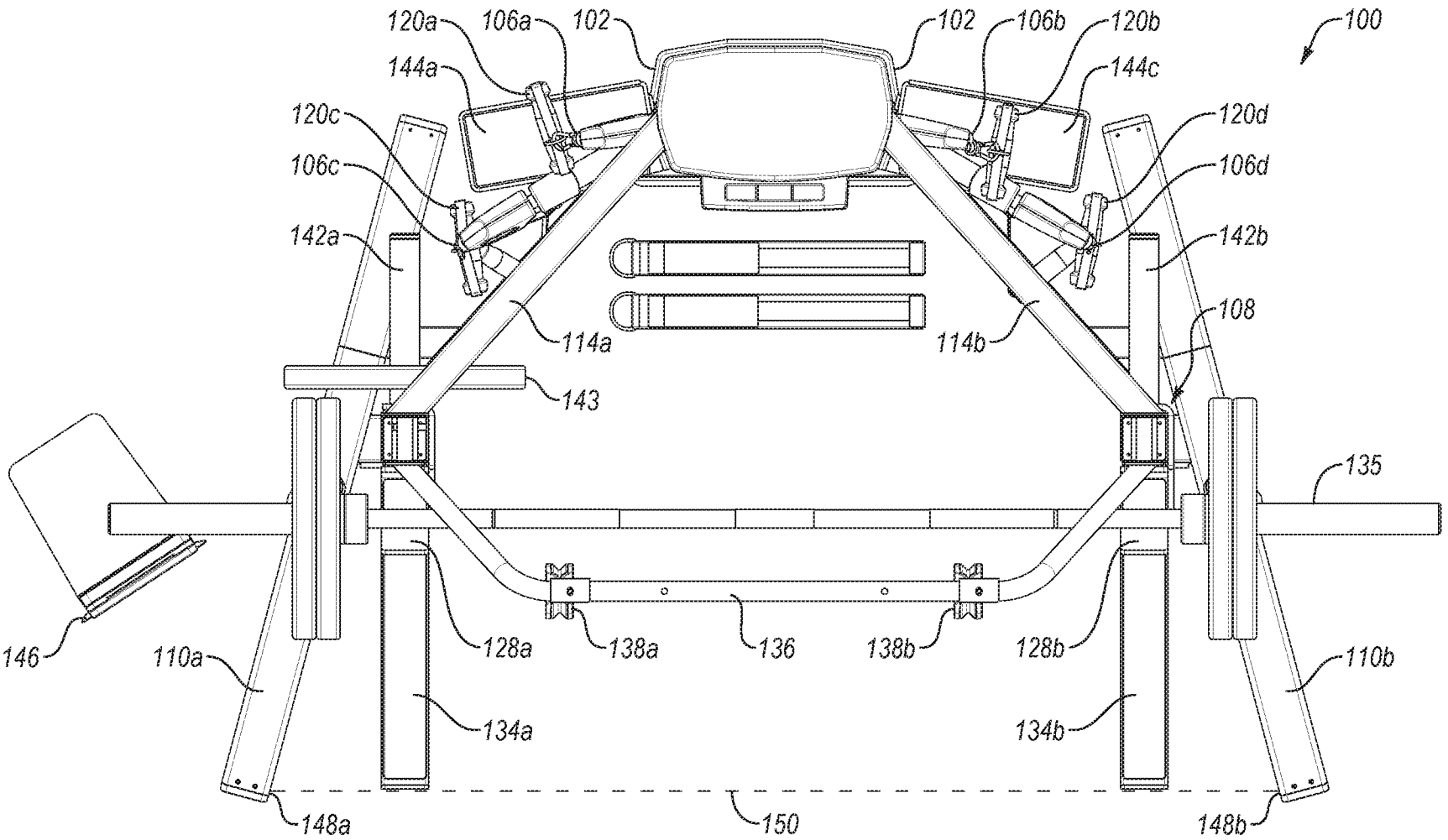

The exercise machine 100 may further include a barbell retention device (see FIG. 1C). The barbell retention device may include a tube 135*a* attached to the frame 102 and configured to be large enough in diameter to receive one end of the barbell 135 (or another barbell) when a user desires to store the barbell 135*a* because it is not currently in use. The barbell retention device may additionally or alternatively include a strap 135*b* attached to the frame 102 and configured to wrap around the other end of the barbell 135 (or another barbell) to keep the barbell 135 securely positioned against the frame 102. The strap 135*b* may be a buckle strap, a hook and loop strap, or any other type of strap.

The exercise machine 100 may further include a bottom-out mechanism configured to prevent the pull cables 106*a*-106*f* from being fully extended, also known as bottoming-out or dead-ending. For example, this bottom-out mechanism may include left and right sensors 148*a* and 148*b* positioned on the left and right legs 110*a* and 110*b*, respectively. The left and right sensors 148*a* and 148*b* may include one or more of an optical sensor, a magnetic sensor, a camera sensor, or an infrared sensor, or some other sensor. The left and right sensors 148*a* and 148*b* may be configured to trigger when any of the pull cables 106*a*-106*f* has been extended to within a threshold of being fully extended (e.g., within 2 feet of being fully extended), when a user has moved past a threshold distance from the exercise machine 100 (such as past the line 150), or when a barbell (such as the barbell 135, which may be a standard Olympic 44-pound or 45-pound barbell) has moved past a threshold distance (such as past the line 150) from the exercise machine 100, among other triggering events. In response to the triggering of the left and right sensors 148*a* and 148*b*, an alarm may alert the user of a danger of any of the pull cables 106*a*-106*f* being fully extended, or the danger of some other event.

Figure 2A:
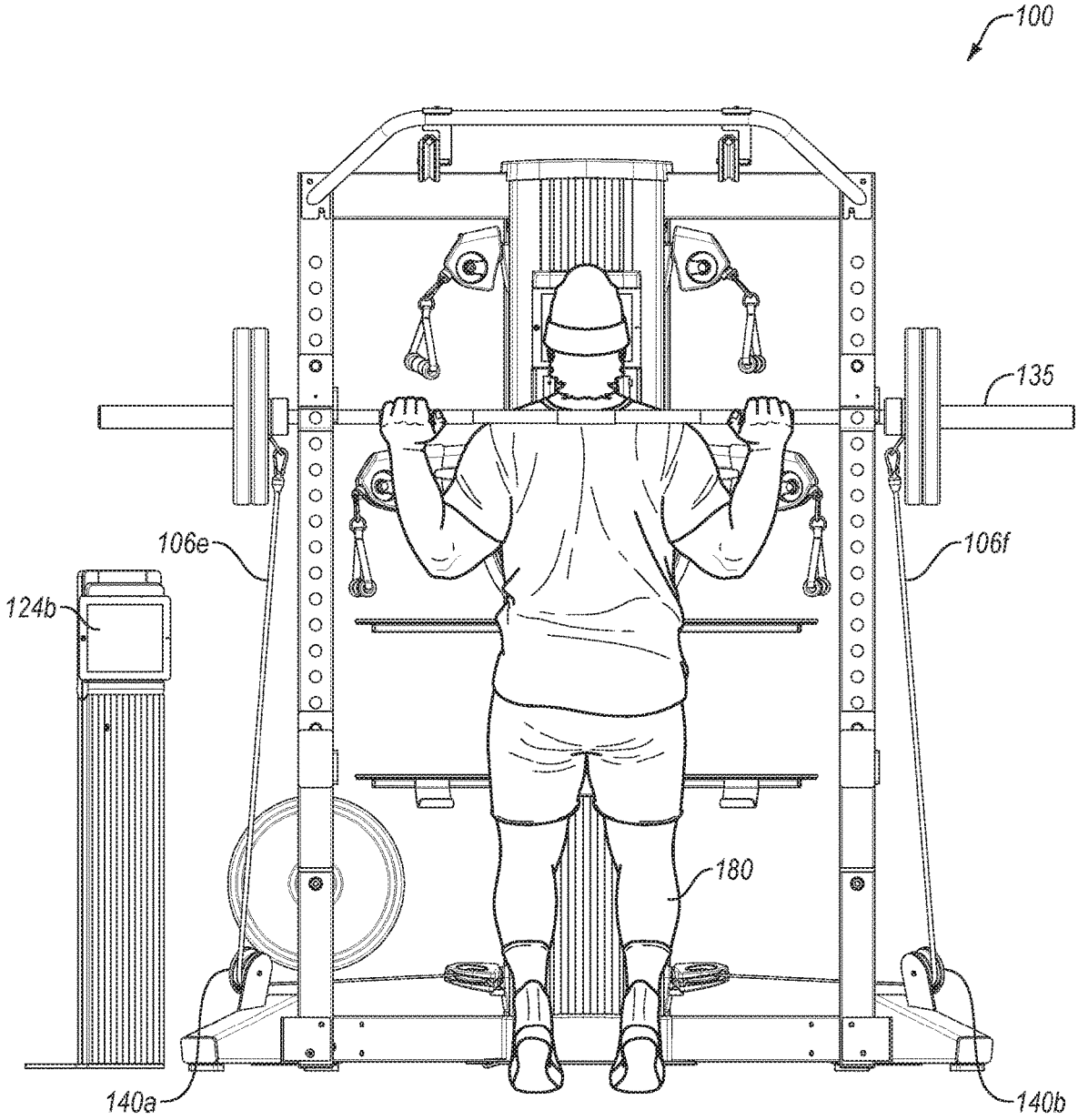
FIGS. 2A-2C illustrate a user preparing to lift, lifting, and squatting with a barbell using the example cable and power rack exercise machine of FIGS. 1A-1E.
Figure 2B:
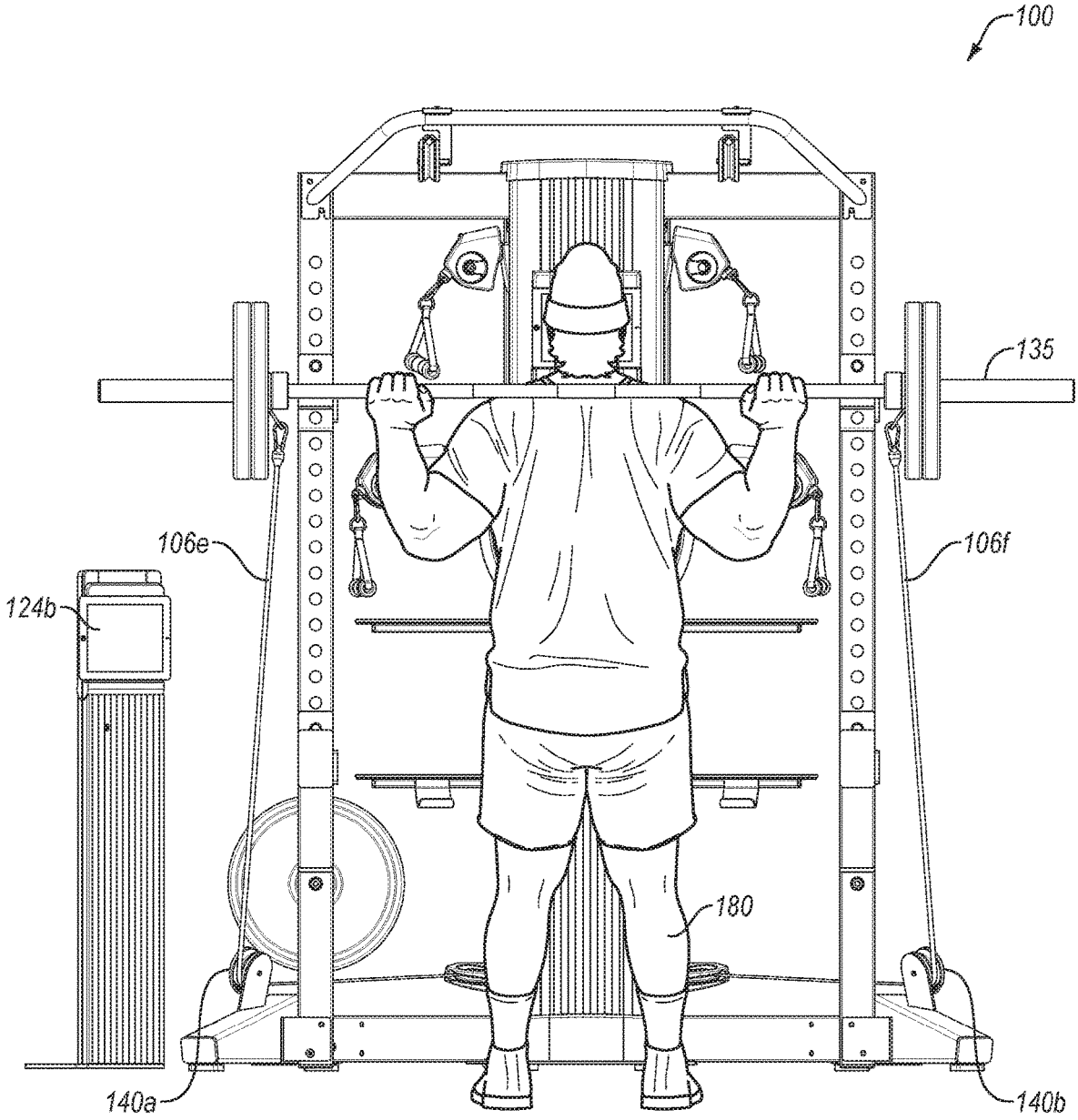
Figure 2C:
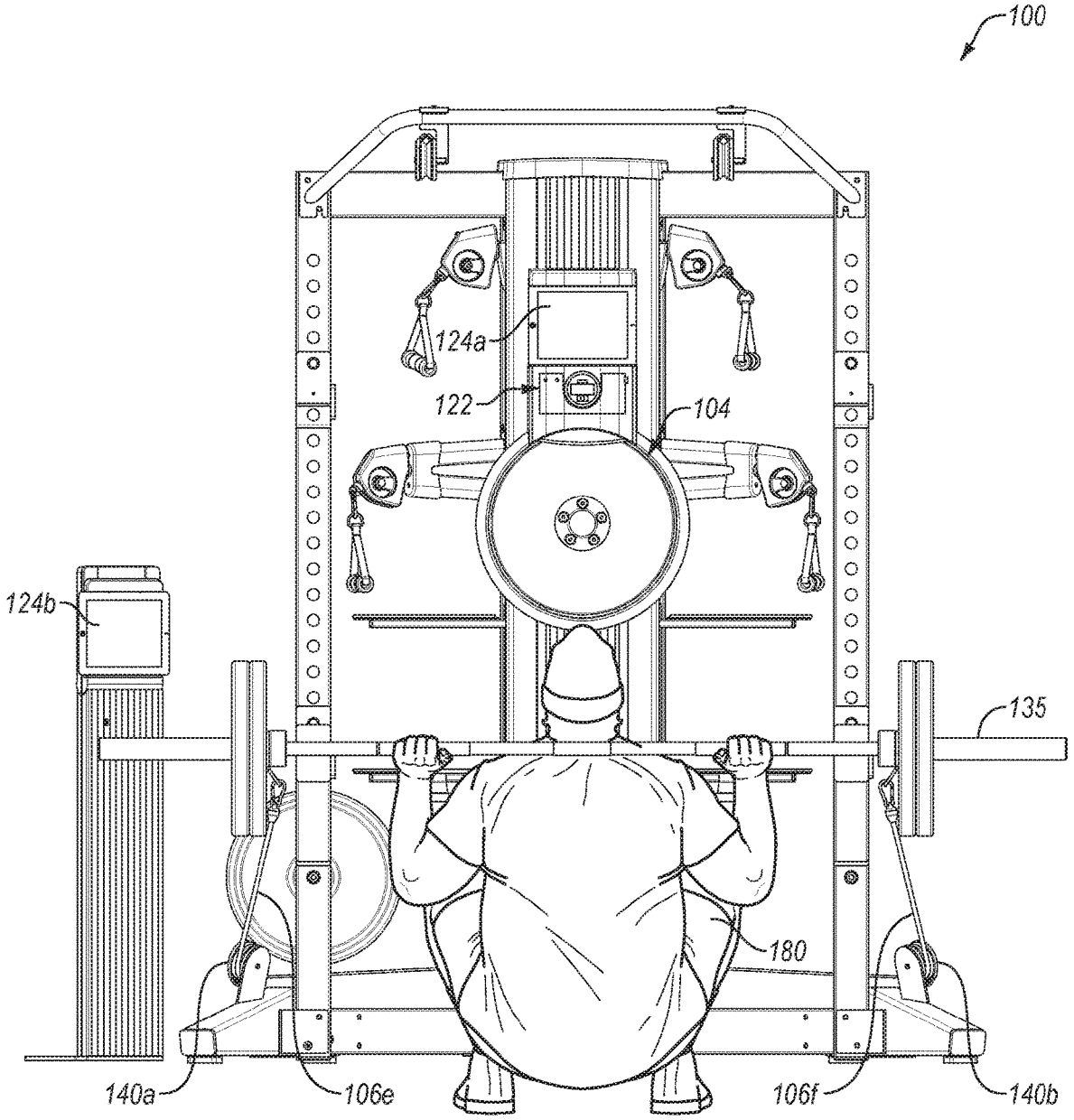

FIGS. 2A-2C illustrate a user 180 preparing to lift, lifting, and squatting with the barbell 135 using the example cable and power rack exercise machine 100 of FIGS. 1A-1E. As illustrated in FIGS. 2A-2C, the left and right lower pulleys 140*a* and 140*b* may be configured to selectively receive the pull cables 106*e* and 106*f*, respectively, after the handles 120*e* and 120*f* have been detached therefrom, in order to enable the pull cables 106*e* and 106*f* to be selectively attached to the barbell 135. This selective attachment of the pull cables 106*e* and 106*f* to the barbell 135 in this manner may enable the left and right tensioner springs 125*a* and 125*b* (see FIG. 1D) to hinder the user 180 in lifting the barbell 135. For example, the left and right tensioner springs 125*a* and 125*b* may each include a spring constant of a particular value of pounds of force per inch (lbf/in). The spring constant may be configured to provide a particular amount of force hindering the user 180 when lifting the barbell 135 as disclosed in FIGS. 2A-2C. For example, the left and right tensioner springs 125*a* and 125*b* may be configured to provide a hindering force between 3-5 pounds, between 2-8 pounds, between 1-11 pounds, or between 2-20 pounds hindering the user 180 when lifting the barbell 135 as disclosed in FIGS. 2A-2C. This force hindering the user 180 may change the more the left and right tensioner springs 125*a* and 125*b* are stretched, following a load versus deflection curve. As disclosed in FIGS. 2A-2C, the force hindering the user 180 may increase as the user 180 lifts the barbell 135 (because the left and right tensioner springs 125*a* and 125*b* become increasingly stretched), and may decrease as the user 180 lowers the barbell 135 (because the left and right tensioner springs 125*a* and 125*b* become decreasingly stretched). In this manner, the left and right tensioner springs 125*a* and 125*b* may hinder the user 180 most when the barbell 135 is at its highest point and when the user 180 may desire hindrance most due to the user 180 having the most amount of leverage. Further, the resistance mechanism 104 may be configured to be selectively set at one of multiple resistance levels, using the console 122 and/or the tablet

124*a* or 124*b* for example, and the selective attachment of the pull cables 106*e* and 106*f* to the barbell 135 via the left and right lower pulleys 140*a* and 140*b* may further enable the resistance mechanism 104 to hinder the user 180 in lifting the barbell 135 in proportion to the set resistance level of the resistance mechanism 104.

Figure 3A:
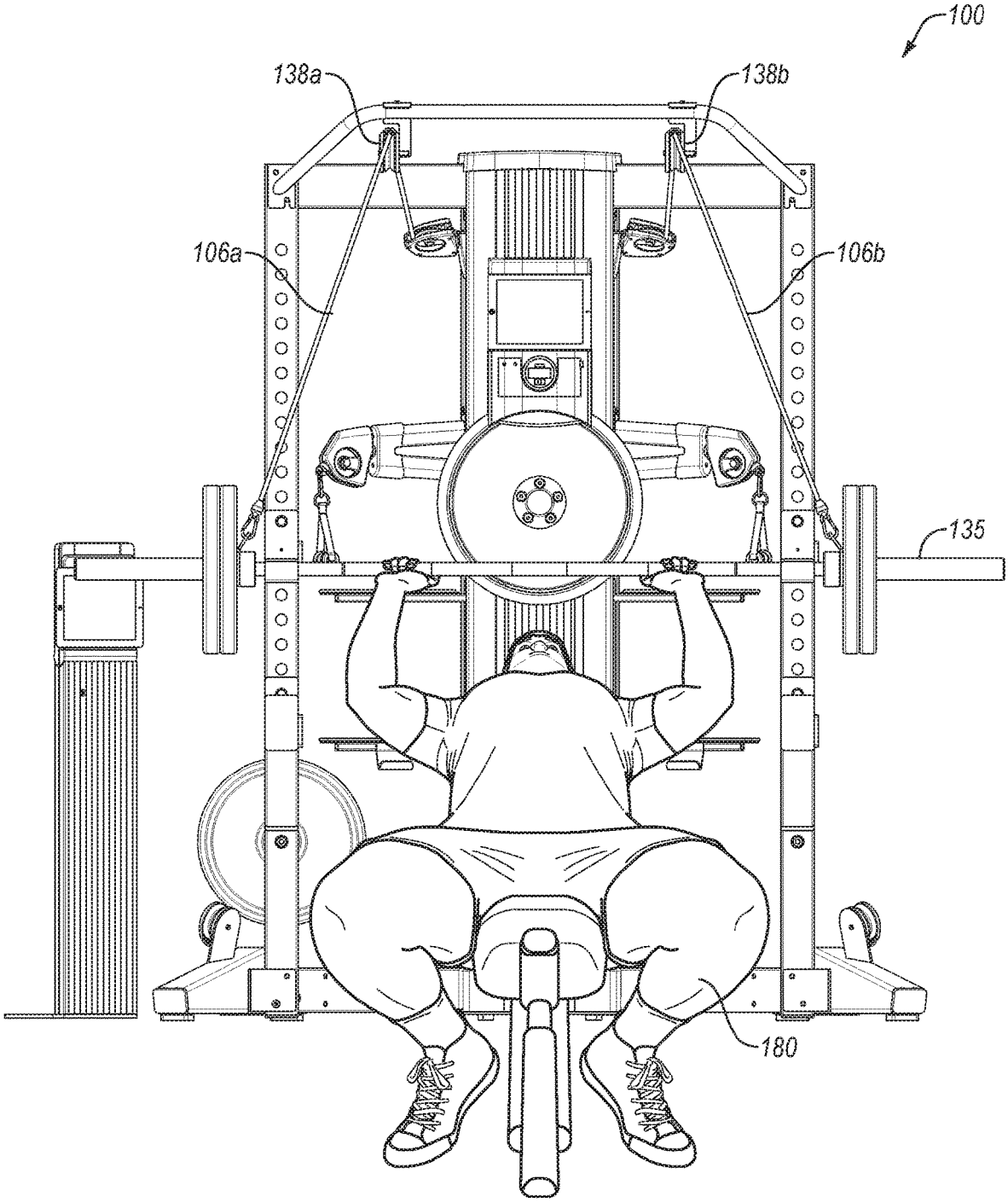
FIGS. 3A-3C illustrate a user preparing to lift, lifting, and lowering a barbell using the example cable and power rack exercise machine of FIGS. 1A-1E.
Figure 3B:
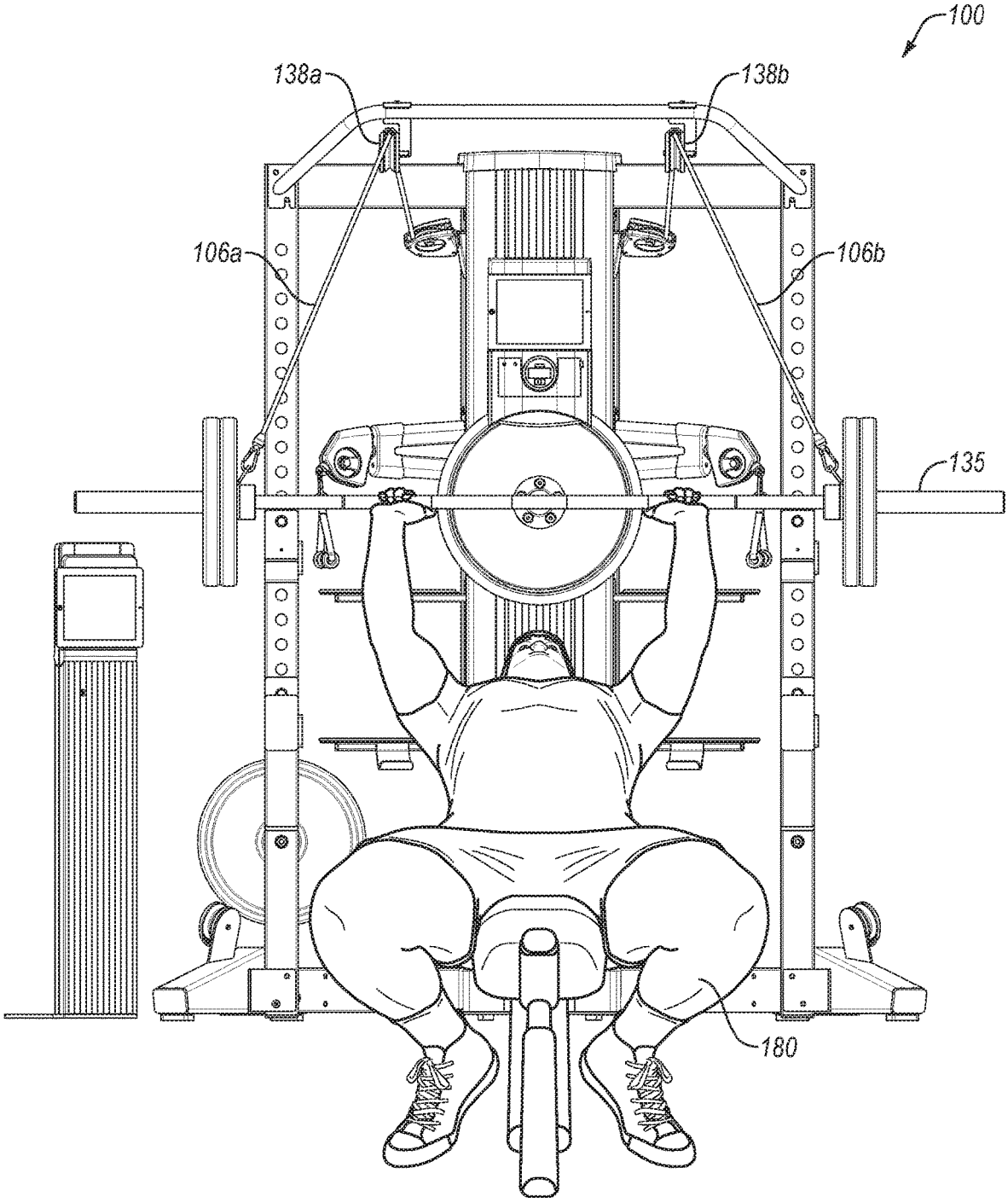
Figure 3C:
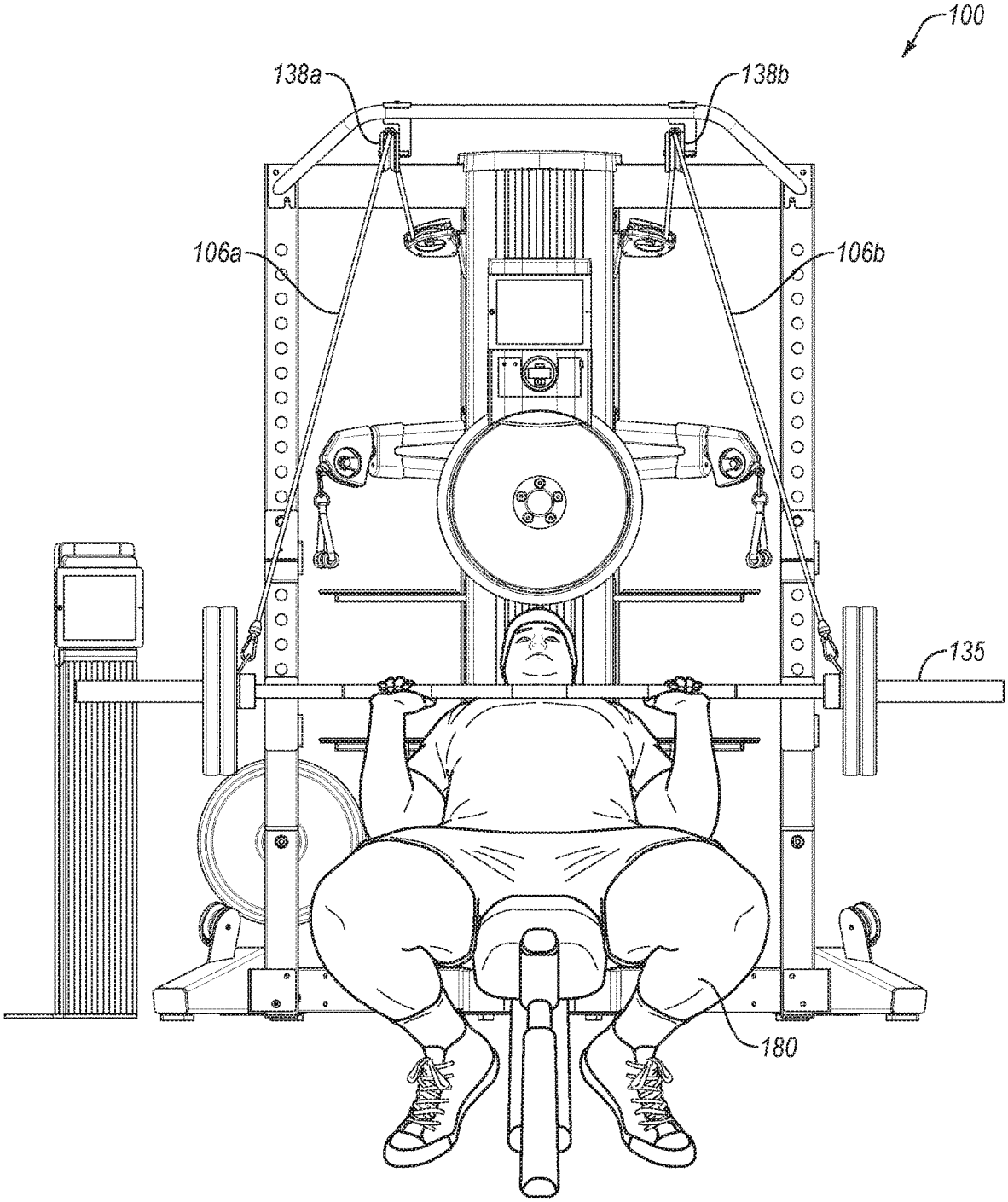

FIGS. 3A-3C illustrate a user preparing to lift, lifting, and lowering a barbell using the example cable and power rack exercise machine 100 of FIGS. 1A-1E. As illustrated in FIGS. 3A-3C, the left and right upper pulleys 138*a* and 138*b* may be configured to selectively receive the pull cables 106*a* and 106*b*, respectively, after the handles 120*a* and 120*b* have been detached therefrom, in order to enable the pull cables 106*a* and 106*b* to be selectively attached to the barbell 135. This selective attachment of the pull cables 106*a* and 106*b* to the barbell 135 in this manner may enable the left and right tensioner springs 125*a* and 125*b* (see FIG. 1D) to assist the user 180 in lifting the barbell 135. For example, the left and right tensioner springs 125*a* and 125*b* may each include a spring constant of a particular value of pounds of force per inch (lbf/in). The spring constant may be configured to provide a particular amount of force assisting the user 180 when lifting the barbell 135 as disclosed in FIGS. 3A-3C. For example, the left and right tensioner springs 125*a* and 125*b* may be configured to provide an assisting force between 3-5 pounds, between 2-8 pounds, between 1-11 pounds, or between 2-20 pounds assisting the user 180 when lifting the barbell 135 as disclosed in FIGS. 3A-3C. This force assisting the user 180 may change the more the left and right tensioner springs 125*a* and 125*b* are stretched, following a load versus deflection curve. As disclosed in FIGS. 3A-3C, the force assisting the user 180 may increase as the user 180 lowers the barbell 135 (because the left and right tensioner springs 125*a* and 125*b* become increasingly stretched), and may decrease as the user 180 lifts the barbell 135 (because the left and right tensioner springs 125*a* and 125*b* become decreasingly stretched). In this manner, the left and right tensioner springs 125*a* and 125*b* may assist the user 180 most when the barbell 135 is at its lowest point and when the user 180 may desire assistance most due to the user 180 having the least amount of leverage.

INDUSTRIAL APPLICABILITY

In general, the example exercise machine disclosed herein may combine features of a cable machine and features of a power rack to yield a superior exercise machine where a user can perform cable workouts, free weight workouts, or combined workouts. In a combined workout, the cables of the exercise machine may be attached to a barbell to assist the user in performing a workout with the barbell by either making the barbell easier to lift or harder to lift, depending on the desired effect. The exercise machine may also include certain bottom-out features that prevent the cables from being fully extended in order to maintain the effective assistance of the cables, while pulling on the cables alone, or when using the cables while attached to the barbell.

The exercise machine disclosed herein may be employed to perform a high-intensity lifting workout, a cardio building workout, or a high intensity interval training (HITT) workout, or some combination thereof. The exercise machine may be employed at a gym or in a home setting.

Various modifications to the example exercise machine disclosed above will now be disclosed.

Although the example exercise machine disclosed herein includes six pull cables, in some embodiments as few as two pull cables or more than six pull cables may be included. Further, pull cables may be positioned at positions other than those illustrated in the drawings.

Further, although tensioner springs are disclosed herein, in some embodiments the tensioner springs may be replaced with any other mechanism that is configured to reduce slack in pull cables, such as elastic cords, counterweights, or other types of springs. In these embodiments, the other mechanism that is configured to reduce slack in pull cables may continue to function as described above in connection with the barbell to either make lifting the barbell easier to lift or harder to lift, depending on the desired effect.

Also, although the resistance mechanism disclosed herein includes a flywheel and one or more magnets arranged to selectively resist rotation of the flywheel, in some embodiments the resistance mechanism may instead include another type of brake (with or without a flywheel), a motor, weights, or other structure(s) capable of providing resistance to pull cables linked thereto. In the case of a motor, the resistance mechanism may double as both a resistance mechanism as well as a mechanism that affirmatively pulls on the pull cables with a set amount of force. In this case, the motor may be attached to a barbell, and may be controlled by a console or other controller to pull on the barbell pull cable(s) upon a command (e.g., a verbal command) of a user, or upon a torque sensor, motion sensor, or other sensor noticing that the user is unable to lift the barbell without some assistance, thus functioning as a virtual spotter to assist the user in lifting the barbell and thus replacing a human spotter. Further, where the resistance mechanism is used to make lifting the barbell harder, the console may be configured to control the resistance mechanism such that the resistance on the barbell gets progressively harder, or progressively easier, to enhance the lifting of the barbell. For example, the resistance mechanism can be controlled to assist a user in lifting the barbell during the final few reps in a set. Alternatively or additionally, the resistance mechanism can be controlled to provide progressive resistance by providing a digital chain that increases the resistance on the barbell with each lift.

Further, although the bottom-out mechanism disclosed herein includes sensors positioned on left and right legs of the exercise machine, in some embodiments the bottom-out mechanism sensors may be positioned anywhere else on the exercise machine, or may be positioned on a separate device in communication with the console of the exercise machine. Further, although the bottom-out mechanism disclosed herein includes sensors, in some embodiments the sensors may be replaced with visual indicators on the pull cables themselves, such as where a pull cable transitions from one color to another, or has another visual marking, when the cable is within a threshold (e.g., within 2 feet) of being fully extended. Also, the bottom-out mechanism disclosed herein may further include one or more brakes configured, in response to a sensor triggering, to engage the pull cables to prevent the pull cables from being extended past some threshold of being fully extended. This brake may prevent a user from pulling a pull cable too far away from the exercise machine.

Also, although the console disclosed herein is discussed as having functionality capable of adjusting the resistance on the resistance mechanism, in some embodiments the console may further be configured with computer functionality to receive input from the user and provide output to the user, and/or configured to control the exercise machine. For example, the console may be employed in connection with the resistance mechanism discussed above in order to allow the user to manually or programmatically alter the amount of resistance that the resistance mechanism applies during the course of a workout on the exercise machine. The console may be configured to communicate over a network (e.g. a Bluetooth network, a WiFi network, or the Internet) with other similar exercise machines, with servers, with computing devices of personal trainers, and with sensors such as heart rate and respiration sensors, etc. Further, the console may be capable of downloading and uploading data in order to, for example, download and upload workouts, data gathered at the exercise machine, and data gathered at other exercise machines, etc. The console may enable a user of the exercise machine to compete with a user of another similar or dissimilar exercise machine, that is local to or remote from the user, with the competing users competing in real-time or at different times. Further, the console may be configured to track the amount of resistance provided by the resistance mechanism, and the number or rotations of the flywheel, during a workout in order to compute the number of calories burned, the amount of energy expended, the amount of work performed, or any other metric or statistic desired by the user. Further, the console may be configured to track the number of cable pulls, the number of barbell lifts and weight lifted, the number of dumbbell lifts and weight lifted, and any other exercise performed in connection with the exercise machine in order to track the number of calories burned, the amount of energy expended, the amount of work performed, or any other metric or statistic desired by the user during a workout using the exercise machine. Further, all data tracked or downloaded by the console may be presented to the user on a display of the console or on a display of another device, such as a tablet or smartphone that is connected via Bluetooth with the console. Further, the console, or another device connected to the console, may be configured to guide a user through a workout using the exercise machine. This guidance may be audible guidance, visual guidance, or some combination of the two, including guidance that employs video depicting exactly what a user should do to follow the workout. In this manner, a user can have the benefit of a trainer without a human trainer present. Further, this guidance may include using lasers or other projected visual indicators to assist a user in performing a workout properly. For example, lasers may be employed to show a user where to place their feet, to show a user how far to pull a pull cable, to show a user how to properly position their hips, knees, joints, head, shoulders, or any other body part to properly perform a cable or free weight exercise. Further, the console may be configured to function as a real-time live video interface to a human trainer who can guide a user through a workout on the exercise machine without the human trainer being present. Further, live or pre-recorded workout sessions may be displayed on the console, or another connected device, such as live studio sessions, powerlifting sessions, full-body sculpting sessions, and world-class coaching sessions. Further, the console may be configured such that a remote trainer, a live video feed, or a pre-recorded video feed or workout can control the resistance or other parameters of the exercise machine. Also, the console may be configured with multiple user profiles to store preferences and other settings for more than one user.

In addition to the accessories disclosed above, in some embodiments the exercise machine may further include other accessories, such as dumbbells, kettlebells, a barbell holder attached to the frame or the power rack for storage of the barbell, an adjustable weight bench for performing weight lifting exercise while lying down, sitting, or somewhere in between lying down or sitting, and a rower attachment that may be connected to one of the pull cables to allow the exercise machine to be used as a rowing machine by a user.

Additionally or alternatively, any of the example components disclosed herein in connection with the exercise machine may be moved from generally mirrored left-and-right positions to other positions, such as non-mirrored positions or center positions. For example, instead of left and right pulleys, a single center pulley may be employed in some situations. In another example, more than two pulleys may function similarly to the left and right pulleys disclosed in the drawings. Therefore, the terms "left" and "right" as disclosed herein are for convenience only and are not intended to dictate generally mirrored left-and-right positions of components.

In accordance with common practice, the various features illustrated in the drawings may not be drawn to scale. The illustrations presented in the present disclosure are not meant to be actual views of any particular apparatus (e.g., device, system, etc.) or method, but are merely example representations that are employed to describe various embodiments of the disclosure. Accordingly, the dimensions of the various features may be arbitrarily expanded or reduced for clarity. In addition, some of the drawings may be simplified for clarity. Thus, the drawings may not depict all of the components of a given apparatus (e.g., device) or all operations of a particular method.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, it is understood that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the summary, detailed description, claims, or drawings, should be understood to contemplate the possibilities of including one of the terms, either of the terms, or both terms. For example, the phrase "A or B" should be understood to include the possibilities of "A" or "B" or "A and B."

Additionally, the use of the terms "first," "second," "third," etc., are not necessarily used herein to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

The foregoing description, for purpose of explanation, has been described with reference to specific embodiments. However, the illustrative discussions above are not intended to be exhaustive or to limit the invention as claimed to the precise forms disclosed. Many modifications and variations are possible in view of the above teachings. The embodiments were chosen and described to explain practical applications, to thereby enable others skilled in the art to utilize the invention as claimed and various embodiments with various modifications as may be suited to the particular use contemplated.

A. An exercise machine comprising:

a frame;

a pull cable supported by the frame; and a power rack attached to the frame, the power rack including:

a first upright post configured to have a first barbell holder attached thereto; and a second upright post configured to have a second barbell holder attached thereto.

B. The exercise machine of example A, further comprising:

a tensioner spring configured to reduce slack in the pull cable;

a first pulley configured to selectively receive the pull cable to enable the pull cable to be selectively attached to a barbell to enable the tensioner spring to assist a user in lifting the barbell, wherein the first tensioner spring is configured to provide between 3-5 pounds, between 2-8 pounds, between 1-11 pounds, or between 2-20 pounds of force assisting the user in lifting the barbell.

C. The exercise machine of example A or B, further comprising:

a second pulley configured to selectively receive the pull cable to enable the pull cable to be selectively attached to a barbell to enable the tensioner spring to hinder a user in lifting the barbell, wherein the first tensioner spring is configured to provide between 3-5 pounds, between 2-8 pounds, between 1-11 pounds, or between 2-20 pounds of force hindering the user in lifting the barbell.

D. The exercise machine of example C, wherein:

the exercise machine further comprises a resistance mechanism supported by the frame and linked to the pull cable;

the resistance mechanism is configured to be selectively set at one of multiple resistance levels; and the second pulley enables the resistance mechanism to hinder the user in lifting the barbell in proportion to the set resistance level of the resistance mechanism.

E. The exercise machine of example D, wherein the resistance mechanism includes:

a flywheel; and one or more magnets arranged to selectively resist rotation of the flywheel.

F. The exercise machine of example D, wherein the resistance mechanism includes a motor.

G. The exercise machine of example A, further comprising:

a motor supported by the frame and linked to the pull cable;

a pulley configured to selectively receive the pull cable to enable the pull cable to be selectively attached to a barbell to enable the motor to assist a user in lifting the barbell.

H. The exercise machine of one of examples A-G, wherein the power rack further includes a pull-up bar supported by the first upright post and by the second upright post.

I. The exercise machine of one of examples A-H, wherein the power rack further includes:

a first weight plate holder supported by the first upright post; and a second weight plate holder supported by the second upright post.

J. The exercise machine of one of examples A-I, wherein the first barbell holder and the second barbell holder are configured as spotter arms to prevent a barbell from falling on a user if the user is unable to continue lifting the barbell.

K. The exercise machine of one of examples A-J, further comprising one or more dumbbell racks supported by the frame and each configured to hold a dumbbell.

L. The exercise machine of one of examples A-K, further comprising a barbell retention mechanism including:

a tube attached to the frame and configured to receive one end of the barbell; and a strap attached to the frame and configured to wrap around the other end of the barbell to keep the other end of the barbell positioned against the frame.

M. An exercise machine comprising:

a frame;

a pull cable supported by the frame; and a bottom-out mechanism configured to prevent the pull cable from being fully extended.

N. The exercise machine of example M, wherein the bottom-out mechanism comprises:

a visual indicator on the pull cable.

O. The exercise machine of example M, wherein the bottom-out mechanism comprises a sensor configured to trigger when one or more of:

the first pull cable and/or the second pull cable has been extended to within a threshold of being fully extended;

a user has moved past a threshold distance from the exercise machine; or a barbell has moved past a threshold distance from the exercise machine.

P. The exercise machine of example 0, wherein the bottom-out mechanism further comprises:

an alarm configured, in response to the sensor triggering, to alert the user of a danger of the first pull cable and/or the second pull cable being fully extended.

Q. The exercise machine of example 0 or P, wherein the bottom-out mechanism further comprises:

one or more brakes configured, in response to the sensor triggering, to engage the first pull cable and/or the second pull cable to prevent the first pull cable and/or the second pull cable from being fully extended.

R. The exercise machine of one of examples O-Q, wherein the sensor comprises one or more of:

an optical sensor;

a magnetic sensor;

a camera sensor; or an infrared sensor.

S. The exercise machine of one of examples M-R, wherein:

the exercise machine further comprises a power rack attached to the frame, the power rack configured to have a first barbell holder and a second barbell holder attached thereto;

the exercise machine further comprises a tensioner spring configured to reduce slack in the pull cable;

the exercise machine further comprises a pulley configured to selectively receive the pull cable to enable the pull cable to be selectively attached to a barbell to enable the tensioner spring to assist a user in lifting the barbell;

the exercise machine further comprises a second pulley configured to selectively receive the pull cable to enable the pull cable to be selectively attached to the barbell to enable the second tensioner spring to hinder the user in lifting the barbell; and the bottom-out mechanism is further configured to prevent the pull cable from being fully extended to avoid a user of the barbell, with the pull cable selectively attached thereto, from being prevented from moving a muscle group through a full range of motion while lifting the barbell.

T. An exercise machine comprising:

a frame;

a resistance mechanism supported by the frame;

a first pull cable and a second pull cable supported by the frame and linked to the resistance mechanism; and a power rack attached to the frame, the power rack including:

a first upright post configured to have a first barbell holder adjustably attached thereto such that the first barbell holder may be adjusted in various positions between a first highest position and a first lowest position on the first upright post; and a second upright post configured to have a second barbell holder adjustably attached thereto such that the second barbell holder may be adjusted in various positions between a second highest position and a second lowest position on the second upright post.

U. The exercise machine of example T, further comprising:

a first tensioner spring configured to reduce slack in the first pull cable; and a second tensioner spring configured to reduce slack in the second pull cable.

V The exercise machine of example U, further comprising:

a first pulley configured to selectively receive the first pull cable to enable the first pull cable to be selectively attached to a barbell to enable the first tensioner spring to assist a user in lifting the barbell, wherein the first tensioner spring is configured to provide between 3-5 pounds, between 2-8 pounds, between 1-11 pounds, or between 2-20 pounds of force assisting the user in lifting the barbell; and a second pulley configured to selectively receive the second pull cable to enable the second pull cable to be selectively attached to the barbell to enable the second tensioner spring to assist the user in lifting the barbell, wherein the second tensioner spring is configured to provide between 3-5 pounds, between 2-8 pounds, between 1-11 pounds, or between 2-20 pounds of force assisting the user in lifting the barbell.

W. The exercise machine of example U, further comprising:

a first pulley configured to selectively receive the first pull cable to enable the first pull cable to be selectively attached to a barbell to enable the first tensioner spring to hinder a user in lifting the barbell, wherein the first tensioner spring is configured to provide between 3-5 pounds, between 2-8 pounds, between 1-11 pounds, or between 2-20 pounds of force hindering the user in lifting the barbell; and a second pulley configured to selectively receive the second pull cable to enable the second pull cable to be selectively attached to the barbell to enable the second tensioner spring to hinder the user in lifting the barbell, wherein the second tensioner spring is configured to provide between 3-5 pounds, between 2-8 pounds, between 1-11 pounds, or between 2-20 pounds of force hindering the user in lifting the barbell.

X. The exercise machine of example W, wherein:

the resistance mechanism is configured to be selectively set at one of multiple resistance levels; and the first pulley and the second pulley enable the resistance mechanism to hinder the user in lifting the barbell in proportion to the set resistance level of the resistance mechanism.

Y. The exercise machine of one of examples T-X, wherein the resistance mechanism includes:

a flywheel; and one or more magnets arranged to selectively resist rotation of the flywheel.

Z. The exercise machine of one of examples T-X, wherein the resistance mechanism includes a motor.

AA. The exercise machine of one of examples T-Z, further comprising:

a motor supported by the frame and linked to the first pull cable and to the second pull cable;

a first pulley configured to selectively receive the first pull cable to enable the first pull cable to be selectively attached to a barbell to enable the motor to assist a user in lifting the barbell; and a second pulley configured to selectively receive the second pull cable to enable the second pull cable to be selectively attached to the barbell to enable the motor to assist the user in lifting the barbell.

BB. The exercise machine of one of examples T-AA, wherein the power rack further includes a pull-up bar supported by the first upright post and by the second upright post.

CC. The exercise machine of one of examples T-BB, wherein the power rack further includes:

a first weight plate holder supported by the first upright post; and a second weight plate holder supported by the second upright post.

DD. The exercise machine of one of examples T-CC, wherein the first barbell holder and the second barbell holder are configured as spotter arms to prevent a barbell from falling on a user if the user is unable to continue lifting the barbell.

EE. The exercise machine of one of examples T-DD, further comprising one or more dumbbell racks supported by the frame and each configured to hold a dumbbell.

FF. The exercise machine of one of examples T-EE, further comprising a barbell retention mechanism including:

a tube attached to the frame and configured to receive one end of the barbell; and a strap attached to the frame and configured to wrap around the other end of the barbell to keep the other end of the barbell positioned against the frame.

GG. An exercise machine comprising:

a frame;

a resistance mechanism supported by the frame;

a first pull cable and a second pull cable supported by the frame and linked to the resistance mechanism; and a bottom-out mechanism configured to prevent the first pull cable and the second pull cable from being fully extended.

HH. The exercise machine of example GG, wherein the bottom-out mechanism comprises:

a first visual indicator on the first pull cable; and a second visual indicator on the second pull cable.

II. The exercise machine of example GG, wherein the bottom-out mechanism comprises a sensor configured to trigger when one or more of:

the first pull cable and/or the second pull cable has been extended to within a threshold of being fully extended;

a user has moved past a threshold distance from the exercise machine; or a barbell has moved past a threshold distance from the exercise machine.

JJ. The exercise machine of example II, wherein the bottom-out mechanism further comprises:

an alarm configured, in response to the sensor triggering, to alert the user of a danger of the first pull cable and/or the second pull cable being fully extended.

KK. The exercise machine of examples II or JJ, wherein the bottom-out mechanism further comprises:

one or more brakes configured, in response to the sensor triggering, to engage the first pull cable and/or the second pull cable to prevent the first pull cable and/or the second pull cable from being fully extended.

LL. The exercise machine of examples II-KK, wherein the sensor comprises one or more of:

an optical sensor;

a magnetic sensor;

a camera sensor; or an infrared sensor.

MM. The exercise machine of one or examples GG-LL, wherein:

the exercise machine further comprises a power rack attached to the frame, the power rack configured to have a first barbell holder and a second barbell holder adjustably attached thereto;

the exercise machine further comprises a first tensioner spring configured to reduce slack in the first pull cable;

the exercise machine further comprises a second tensioner spring configured to reduce slack in the second pull cable;

the exercise machine further comprises a first pulley configured to selectively receive the first pull cable to enable the first pull cable to be selectively attached to a barbell to enable the first tensioner spring to assist a user in lifting the barbell;

the exercise machine further comprises a second pulley configured to selectively receive the second pull cable to enable the second pull cable to be selectively attached to the barbell to enable the second tensioner spring to assist the user in lifting the barbell; and the bottom-out mechanism is further configured to prevent the first pull cable and the second pull cable from being fully extended to avoid a user of the barbell, with the first pull cable and the second pull cable selectively attached thereto, from being prevented from moving a muscle group through a full range of motion while lifting the barbell.

The invention claimed is:

1. An exercise machine comprising:

a frame;

a resistance mechanism supported by the frame, wherein the resistance mechanism includes:

a motor; or a flywheel and one or more magnets arranged to selectively resist rotation of the flywheel;

a first pull cable and a second pull cable supported by the frame and linked to the resistance mechanism;

a power rack attached to the frame, the power rack including:

a first upright post configured to have a first barbell holder adjustably attached thereto such that the first barbell holder is configured to be adjusted in various positions between a first highest position and a first lowest position on the first upright post; and a second upright post configured to have a second barbell holder adjustably attached thereto such that the second barbell holder is configured to be adjusted in various positions between a second highest position and a second lowest position on the second upright post;

a first tensioner spring configured to reduce slack in the first pull cable;

a second tensioner spring configured to reduce slack in the second pull cable;

a first pulley configured to selectively receive the first pull cable to enable the first pull cable to be selectively attached to a barbell to enable the first tensioner spring to hinder a user in lifting the barbell; and a second pulley configured to selectively receive the second pull cable to enable the second pull cable to be selectively attached to the barbell to enable the second tensioner spring to hinder the user in lifting the barbell.

2. The exercise machine of claim 1, wherein:

the first tensioner spring is configured to provide between 3-5 pounds, between 2-8 pounds, between 1-11 pounds, or between 2-20 pounds of force hindering the user in lifting the barbell; and the second tensioner spring is configured to provide between 3-5 pounds, between 2-8 pounds, between 1-11 pounds, or between 2-20 pounds of force hindering the user in lifting the barbell.

3. The exercise machine of claim 2, wherein:

the resistance mechanism is configured to be selectively set at one of multiple resistance levels; and the first pulley and the second pulley enable the resistance mechanism to hinder the user in lifting the barbell in proportion to the set resistance level of the resistance mechanism.

4. The exercise machine of claim 1, further comprising:

a third pull cable and a fourth pull cable supported by the frame and linked to the resistance mechanism;

a third pulley configured to selectively receive the third pull cable to enable the third pull cable to be selectively attached to the barbell to enable the first tensioner spring to assist the user in lifting the barbell, wherein the first tensioner spring is configured to provide between 3-5 pounds, between 2-8 pounds, between 1-11 pounds, or between 2-20 pounds of force assisting the user in lifting the barbell; and a fourth pulley configured to selectively receive the fourth pull cable to enable the fourth pull cable to be selectively attached to the barbell to enable the second tensioner spring to assist the user in lifting the barbell, wherein the second tensioner spring is configured to provide between 3-5 pounds, between 2-8 pounds, between 1-11 pounds, or between 2-20 pounds of force assisting the user in lifting the barbell.

5. The exercise machine of claim 1, wherein the resistance mechanism includes the motor, the exercise machine further comprising:

a third pull cable and a fourth pull cable supported by the frame and linked to the resistance mechanism;

a third pulley configured to selectively receive the third pull cable to enable the third pull cable to be selectively attached to the barbell to enable the motor to assist the user in lifting the barbell; and a fourth pulley configured to selectively receive the fourth pull cable to enable the fourth pull cable to be selectively attached to the barbell to enable the motor to assist the user in lifting the barbell.

6. The exercise machine of claim 1, wherein the power rack further includes a pull-up bar supported by the first upright post and by the second upright post.

7. The exercise machine of claim 1, wherein the power rack further includes:

a first weight plate holder supported by the first upright post; and a second weight plate holder supported by the second upright post.

8. The exercise machine of claim 1, further comprising a first spotter arm adjustably attached to the first upright post and a second spotter arm adjustably attached to the second upright post, the first and second spotter arms configured to prevent the barbell from falling on the user if the user is unable to continue lifting the barbell.

9. The exercise machine of claim 1, further comprising one or more dumbbell racks supported by the frame and each configured to hold a dumbbell.

10. The exercise machine of claim 1, further comprising a barbell retention mechanism including:

a tube attached to the frame and configured to receive a first end of the barbell; and a strap attached to the frame and configured to wrap around a second end of the barbell to keep the second end of the barbell positioned against the frame.

11. An exercise machine comprising:

a frame;

a resistance mechanism supported by the frame, wherein the resistance mechanism includes:

a motor; or a flywheel and one or more magnets arranged to selectively resist rotation of the flywheel;

a first pull cable and a second pull cable supported by the frame and linked to the resistance mechanism;

a power rack attached to the frame, the power rack including:

a first upright post configured to have a first barbell holder adjustably attached thereto such that the first barbell holder is configured to be adjusted in various positions between a first highest position and a first lowest position on the first upright post; and a second upright post configured to have a second barbell holder adjustably attached thereto such that the second barbell holder is configured to be adjusted in various positions between a second highest position and a second lowest position on the second upright post;

a tube attached to the frame and configured to receive a first end of a barbell; and a strap attached to the frame and configured to wrap around a second end of the barbell to keep the second end of the barbell positioned against the frame.

12. The exercise machine of claim 11, further comprising:

a first tensioner spring configured to reduce slack in the first pull cable; and a second tensioner spring configured to reduce slack in the second pull cable.

13. The exercise machine of claim 12, further comprising:

a first pulley configured to selectively receive the first pull cable to enable the first pull cable to be selectively attached to the barbell to enable the first tensioner spring to hinder a user in lifting the barbell, wherein the first tensioner spring is configured to provide between 3-5 pounds, between 2-8 pounds, between 1-11 pounds, or between 2-20 pounds of force hindering the user in lifting the barbell; and a second pulley configured to selectively receive the second pull cable to enable the second pull cable to be selectively attached to the barbell to enable the second tensioner spring to hinder the user in lifting the barbell, wherein the second tensioner spring is configured to provide between 3-5 pounds, between 2-8 pounds, between 1-11 pounds, or between 2-20 pounds of force hindering the user in lifting the barbell.

14. The exercise machine of claim 13, wherein:

the resistance mechanism is configured to be selectively set at one of multiple resistance levels; and the first pulley and the second pulley enable the resistance mechanism to hinder the user in lifting the barbell in proportion to the set resistance level of the resistance mechanism.

15. The exercise machine of claim 12, further comprising:

a first pulley configured to selectively receive the first pull cable to enable the first pull cable to be selectively attached to the barbell to enable the first tensioner spring to assist a user in lifting the barbell, wherein the first tensioner spring is configured to provide between 3-5 pounds, between 2-8 pounds, between 1-11 pounds, or between 2-20 pounds of force assisting the user in lifting the barbell; and a second pulley configured to selectively receive the second pull cable to enable the second pull cable to be selectively attached to the barbell to enable the second tensioner spring to assist the user in lifting the barbell, wherein the second tensioner spring is configured to provide between 3-5 pounds, between 2-8 pounds, between 1-11 pounds, or between 2-20 pounds of force assisting the user in lifting the barbell.

16. The exercise machine of claim 11, wherein the resistance mechanism includes the motor, the exercise machine further comprising:

a first pulley configured to selectively receive the first pull cable to enable the first pull cable to be selectively attached to the barbell to enable the motor to assist a user in lifting the barbell; and a second pulley configured to selectively receive the second pull cable to enable the second pull cable to be selectively attached to the barbell to enable the motor to assist the user in lifting the barbell.

17. The exercise machine of claim 11, wherein the power rack further includes a pull-up bar supported by the first upright post and by the second upright post.

18. The exercise machine of claim 11, wherein the power rack further includes:

a first weight plate holder supported by the first upright post; and a second weight plate holder supported by the second upright post.

19. The exercise machine of claim 11, further comprising a first spotter arm adjustably attached to the first upright post and a second spotter arm adjustably attached to the second upright post, the first and second spotter arms configured to prevent the barbell from falling on the user if the user is unable to continue lifting the barbell.

20. The exercise machine of claim 11, further comprising one or more dumbbell racks supported by the frame and each configured to hold a dumbbell.

* * * * *